US010505260B2

(12) United States Patent
Inoue et al.

(10) Patent No.: US 10,505,260 B2
(45) Date of Patent: Dec. 10, 2019

(54) ANTENNA DEVICE, METHOD OF MANUFACTURING ANTENNA DEVICE, AND WIRELESS DEVICE

(71) Applicant: KABUSHIKI KAISHA TOSHIBA, Tokyo (JP)

(72) Inventors: Kazuhiro Inoue, Tokyo (JP); Takafumi Ohishi, Kanagawa (JP); Makoto Higaki, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 256 days.

(21) Appl. No.: 15/260,809

(22) Filed: Sep. 9, 2016

(65) Prior Publication Data

US 2016/0380340 A1 Dec. 29, 2016

Related U.S. Application Data

(63) Continuation of application No. PCT/JP2014/083767, filed on Dec. 19, 2014.

(30) Foreign Application Priority Data

May 29, 2014 (JP) ..... 2014-111290

(51) Int. Cl.
*H01Q 1/24* (2006.01)
*H01Q 9/04* (2006.01)
(Continued)

(52) U.S. Cl.
CPC ..... *H01Q 1/243* (2013.01); *H01Q 1/38* (2013.01); *H01Q 1/48* (2013.01); *H01Q 9/0407* (2013.01); *H01Q 21/08* (2013.01)

(58) Field of Classification Search
CPC ..... H01Q 1/2291; H01Q 1/24; H01Q 1/241; H01Q 1/242; H01Q 1/243; H01Q 1/273;
(Continued)

(56) References Cited

U.S. PATENT DOCUMENTS 5,420,596 A * 5/1995 Burrell ..... H01Q 1/243 343/700 MS
6,236,367 B1 * 5/2001 Du Toit ..... H01Q 9/0407 343/700 MS
(Continued)

FOREIGN PATENT DOCUMENTS

JP 07-131234 5/1995
JP H07131234 * 5/1995 ..... H01Q 1/38
(Continued)

OTHER PUBLICATIONS

Search Report and Written Opinion dated Mar. 3, 2015 in International Application No. PCT/JP2014/083767.
(Continued)

*Primary Examiner* — Daniel Munoz
*Assistant Examiner* — Patrick R Holecek
(74) *Attorney, Agent, or Firm* — Nixon & Vanderhye, P.C.

(57) ABSTRACT

An antenna device includes a finite ground plane that includes a linear side, a first conductor plate that faces the finite ground plane and includes a side corresponding to the side of the finite ground plane and having a length of substantially a ⅛ wavelength or less, and a conductor line that includes one end connected to the side of the first conductor plate and the other end short-circuited to one end portion of the side of the finite ground plane. The antenna device further includes a second conductor plate that faces the finite ground plane, includes a side corresponding to the side of the finite ground plane and having a length of substantially a ⅛ wavelength or less, and is arranged to be adjacent to the first conductor plate to perform capacitive coupling with the first conductor plate and a feed line that includes one end connected to the side of the second conductor plate and the other end connected to the other end portion of the side of the finite ground plane.

15 Claims, 29 Drawing Sheets

(51) Int. Cl.
*H01Q 1/38* (2006.01)
*H01Q 1/48* (2006.01)
*H01Q 21/08* (2006.01)

(58) Field of Classification Search
CPC ..... H01Q 1/38; H01Q 1/48; H01Q 19/005; H01Q 21/08; H01Q 9/0407–0478
See application file for complete search history.

(56) References Cited

U.S. PATENT DOCUMENTS

| | | | | |
|---|---|---|---|---|
| 6,295,030 | B1 * | 9/2001 | Kozakai | H01Q 1/243 343/700 MS |
| 6,674,411 | B2 | 1/2004 | Boyle | |
| 7,046,196 | B1 * | 5/2006 | Langley | H01Q 1/243 343/700 MS |
| 7,728,785 | B2 * | 6/2010 | Ozden | H01Q 1/243 343/866 |
| 7,994,984 | B2 | 8/2011 | Inoue et al. | |
| 2002/0149524 | A1 | 10/2002 | Boyle | |
| 2005/0275596 | A1 | 12/2005 | Harano | |
| 2009/0079654 | A1 | 3/2009 | Higaki et al. | |
| 2009/0140929 | A1 | 6/2009 | Inoue et al. | |
| 2013/0021218 | A1 | 1/2013 | Asanuma et al. | |

FOREIGN PATENT DOCUMENTS

| | | |
|---|---|---|
| JP | 11-041026 | 2/1999 |
| JP | 11-127014 | 5/1999 |
| JP | 2917316 | 7/1999 |
| JP | 2004-519915 | 7/2004 |
| JP | 4063833 | 3/2008 |
| JP | 2009-135797 | 6/2009 |
| JP | 4970206 | 7/2012 |
| WO | 02/071541 | 9/2002 |
| WO | 2012/104941 | 8/2012 |
| WO | WO 2012/104941 | 8/2012 |

OTHER PUBLICATIONS

International Search Report for PCT/JP2014/083767, dated Mar. 3, 2015.
Written Opinion of the ISA (foreign language) for PCT/JP2014/083767, dated Mar. 3, 2015.

* cited by examiner

| RADIATION EFFICIENCY [dB] | | -8.03 |
|---|---|---|
| DIRECTIVITY [dBi] | MAXIMUM VALUE | 5.63 |
| | MAXIMUM VALUE AT θ=90° | 1.94 |
| | AVERAGE VALUE AT θ=90° | -0.53 |

ANTENNA DEVICE, METHOD OF MANUFACTURING ANTENNA DEVICE, AND WIRELESS DEVICE

CROSS-REFERENCE TO RELATED APPLICATIONS

This application is a continuation of PCT international application Ser. No. PCT/JP2014/083767 filed on Dec. 19, 2014, which designates the United States; the entire contents of which are incorporated herein by reference.

FIELD

The embodiments discussed herein are related to an antenna device, a method of manufacturing an antenna device, and a wireless device.

BACKGROUND

In the past, a technique of downsize an antenna device by including a parasitic element that performs capacitive coupling with an antenna element is known.

However, in an antenna device according to a related art, in order to further downsize an antenna device, when an antenna element is installed near a substrate, a bandwidth at which impedance matching is made is very narrowed. For this reason, there is a problem in that it is difficult to further downsize an antenna device while securing a bandwidth at which impedance matching is made.

DETAILED DESCRIPTION

According to an embodiment, an antenna device includes a finite ground plane that includes a linear side, a first conductor plate that faces the finite ground plane and includes a side corresponding to the side of the finite ground plane and having a length of substantially a ⅛ wavelength or less, and a conductor line that includes one end connected to the side of the first conductor plate and the other end short-circuited to one end portion of the side of the finite ground plane. The antenna device further includes a second conductor plate that faces the finite ground plane, includes a side corresponding to the side of the finite ground plane and having a length of substantially a ⅛ wavelength or less, and is arranged to be adjacent to the first conductor plate to perform capacitive coupling with the first conductor plate and a feed line that includes one end connected to the side of the second conductor plate and the other end connected to the other end portion of the side of the finite ground plane.

First Embodiment

Figure 1A:
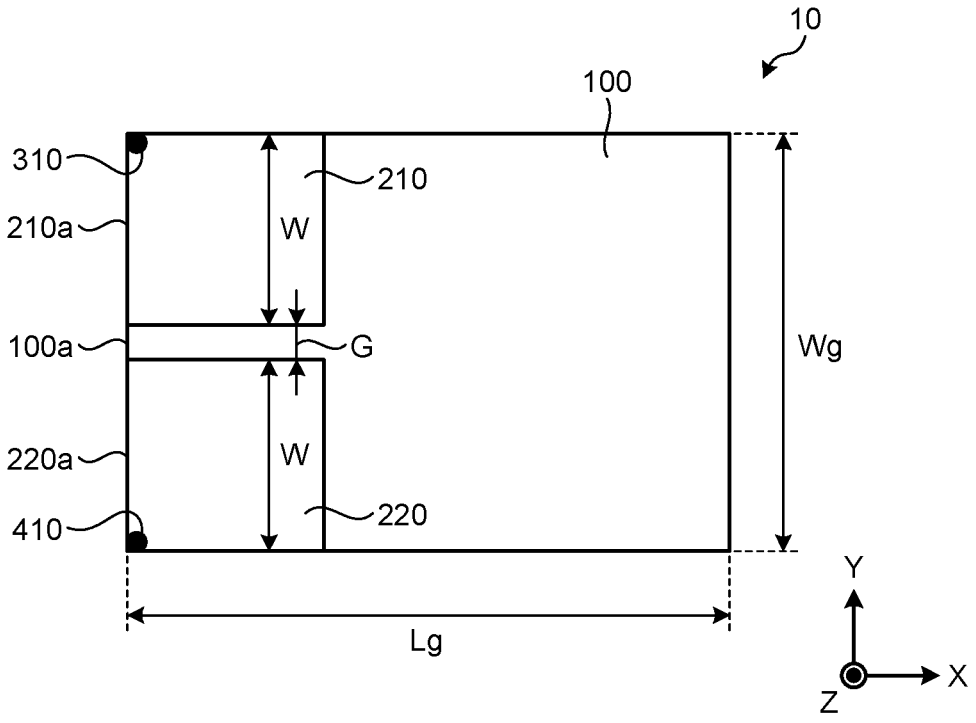
FIG. 1A is a diagram illustrating a configuration of an antenna device according to a first embodiment.
Figure 1B:
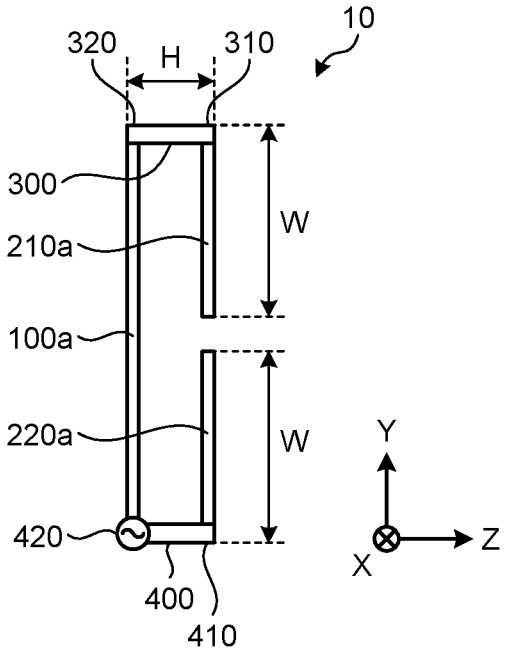
FIG. 1B is a diagram illustrating a configuration of the antenna device according to the first embodiment.
Figure 1C:
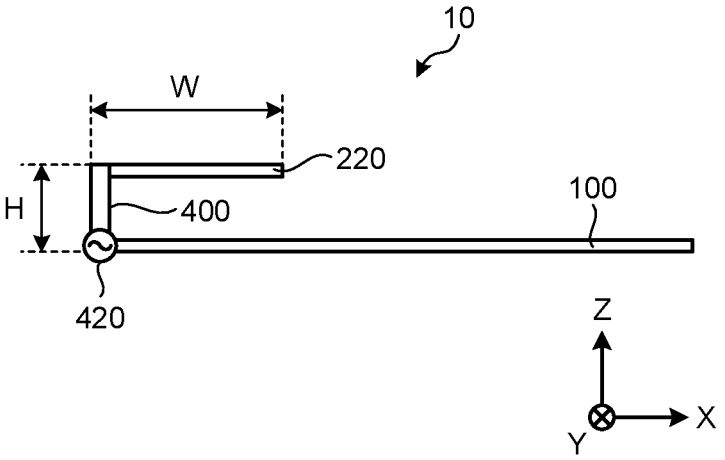
FIG. 1C is a diagram illustrating a configuration of the antenna device according to the first embodiment.

FIGS. 1A to 1C are diagrams illustrating a configuration of an antenna device 10 according to a first embodiment. In order to facilitate understanding of a description, a three-dimensional orthogonal coordinate system including a Y axis in which an upper direction is a positive direction, and a lower direction is a negative direction is illustrated in FIGS. 1A and 1B. This orthogonal coordinate system is illustrated in the other drawings used in the following description.

Here, FIG. 1A is a top view illustrating the antenna device 10 according to the present embodiment which is viewed in a Z-axis direction. FIG. 1B is a side view illustrating the antenna device 10 which is viewed in an X-axis direction, and FIG. 1C is a side view illustrating the antenna device 10 which is viewed in a Y-axis direction.

The antenna device 10 includes a finite ground plane 100, a first conductor plate 210, a second conductor plate 220, a conductor line 300, and a feed line 400.

The finite ground plane 100 is a rectangular conductor plate of a length Lg and a width Wg having a linear side 100*a*. The first and second conductor plates 210 and 220 are arranged to face the finite ground plane 100. The second conductor plate 220 is arranged to be adjacent to the first conductor plate 210 with a gap G therebetween so that the second conductor plate 220 performs capacitive coupling with the first conductor plate 210.

The first and second conductor plates 210 and 220 are substantially square conductor plates of a length W having linear sides 210*a* and 220*a*. The lengths W of the sides of the first and second conductor plates 210 and 220 corresponding to the side 100*a* of the finite ground plane 100 are substantially a ⅛ wavelength or less.

Here, the sides corresponding to the side 100*a* of the finite ground plane 100 indicate the sides that are parallel to the side 100*a* and closest to the side 100*a*. In the example of FIGS. 1A to 1C, the side of the first conductor plate 210 corresponding to the side 100*a* is the side 210*a*, and the side of the second conductor plate 220 corresponding to the side 100*a* is the side 220*a*.

The conductor line 300 and the feed line 400 are conductive lines having a length H. One end of the conductor line 300 is connected to the side 210*a* of the first conductor plate 210, and the other end thereof, and the other end is short-circuited to one end portion 320 of the side 100*a* of the finite ground plane 100. In the present embodiment, one end of the conductor line 300 is connected to one end portion 310 of the side 210*a*.

One end of the feed line 400 is connected to the side 220*a* of the second conductor plate 220, and the other end thereof is connected to one end portion 420 of the side 100*a* of the finite ground plane 100. In the present embodiment, one end of the feed line 400 is connected to one end portion 410 of the side 220*a*.

Here, for example, one end portion 420 is connected with a signal line of a radio unit (not illustrated) and operates as a feed point. The second conductor plate 220 operates as an antenna element, and the first conductor plate 210 operates as a parasitic element.

The conductor line 300 and the feed line 400 are connected to be substantially orthogonal to the finite ground plane 100. Therefore, the height of the first and second conductor plates 210 and 220 from the finite ground plane 100 is substantially equal to the length H of the conductor line 300 and the feed line 400.

Figure 2A:
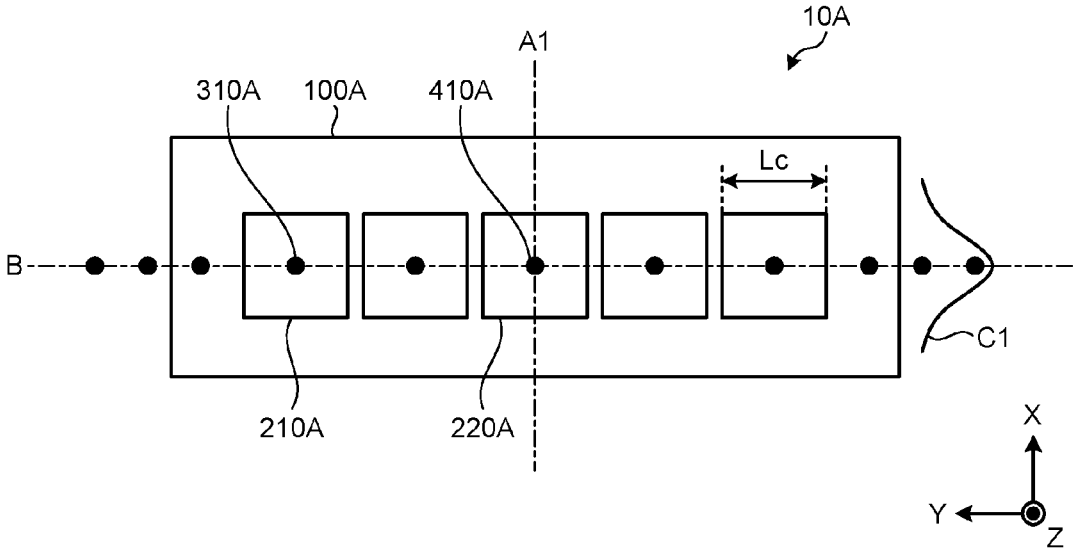
FIG. 2A is a diagram for describing an operation principle of the antenna device according to the first embodiment.
Figure 2B:
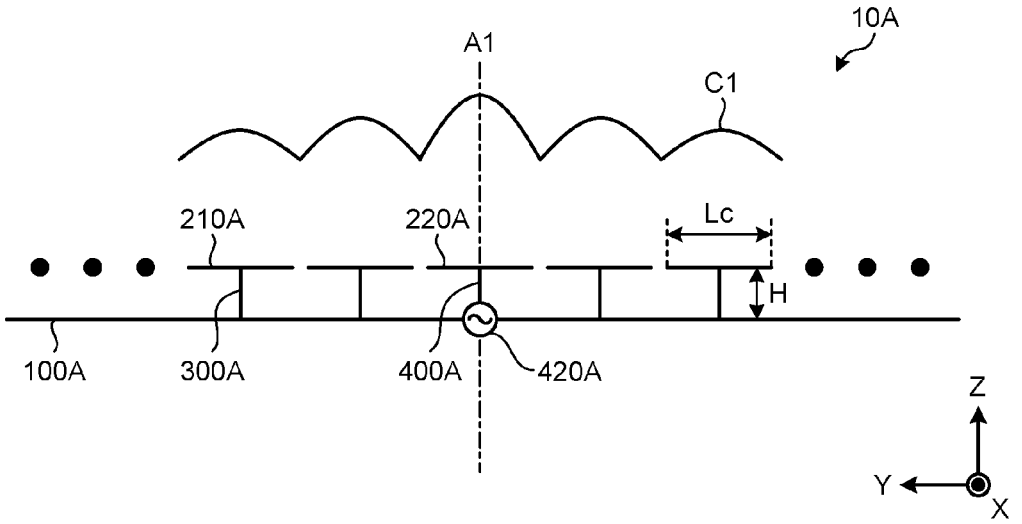
FIG. 2B is a diagram for describing an operation principle of the antenna device according to the first embodiment.

An operation principle of the antenna device 10 and the length W of the sides 210*a* and 220*a* will be described with reference to FIGS. 2A to 2E. FIGS. 2A and 2B are a top view and a side view for describing the operation principle of the antenna device 10. Curved lines C1 and C2 in FIGS. 2A to 2C indicate distributions of electric currents flowing in the antenna devices 10 and 10A.

Figure 2C:
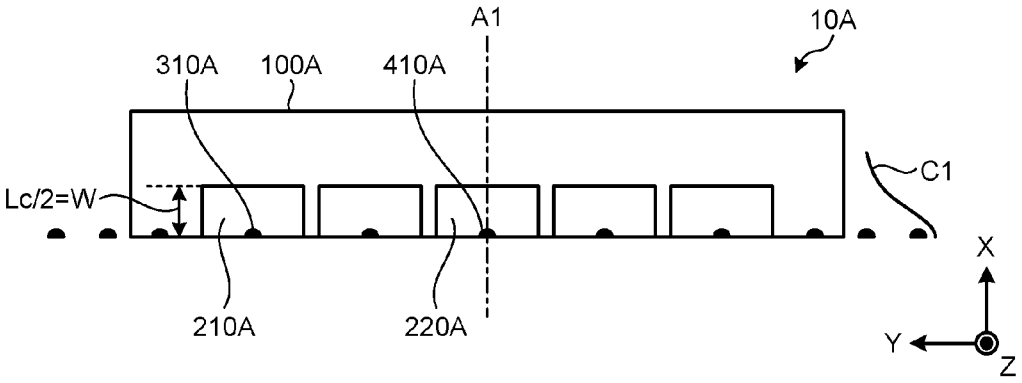
FIG. 2C is a diagram for describing an operation principle of the antenna device according to the first embodiment.

The antenna device 10A illustrated in FIGS. 2A to 2C includes a ground plane 100A having a length Lgc (=2×Lg) and an infinite width. The antenna device 10A illustrated in FIGS. 2A to 2C corresponds to one in which the antenna device 10 of FIGS. 1A to 1C is rotated 90° around the Z axis.

The antenna device 10A includes a conductor patch 220A arranged on a straight line B of the ground plane 100A. The antenna device 10A further includes a feed line 400A that connects the conductor patch 220A with the ground plane 100A and a feed point 420A. The straight line B illustrated in FIG. 2A is a line that bisects the length Lgc of the ground plane 100A, and a straight line A1 is a line that passes through the feed line 400A and is orthogonal to the straight line B.

The antenna device 10A includes a plurality of conductor patches 210A that are arranged in a line at both sides of the conductor patch 220A on the straight line B and a plurality of conductor lines 300A that short-circuit a plurality of conductor patches 210A with the ground plane 100A.

The conductor patches 210A and 220A are substantially square conductor plates having sides with a length Lc (=2×W). One ends of the conductor line 300A and the feed line 400A are connected to substantially the centers of the conductor batches 210A and 220A.

As described above, the antenna device 10A illustrated in FIGS. 2A and 2B causes the conductor patch 220A to operate as an antenna element by directly exciting one conductor patch 220A among 1×N (N=1, 2, . . . ) substrates having a mushroom type EBG structure.

A substrate having a mushroom type EBG structure of an infinite period is known to operate as a high impedance substrate in principle. Therefore, the antenna device 10A illustrated in FIGS. 2A and 2B operates as a high impedance substrate as well.

Here, an example in which the antenna device 10A has a band gap at a center frequency fc (a wavelength λc), and a surface impedance is Zs(f)(Zs(f→fc)→∞) is considered.

As illustrated in FIG. 2C, the antenna device 10A is divided in half by a plane passing through the straight line B. Since the antenna device 10A has a symmetric structure with respect to the straight line B, the surface impedance of the antenna device 10A after divided is roughly Zs(f)/2.

Figure 2D:
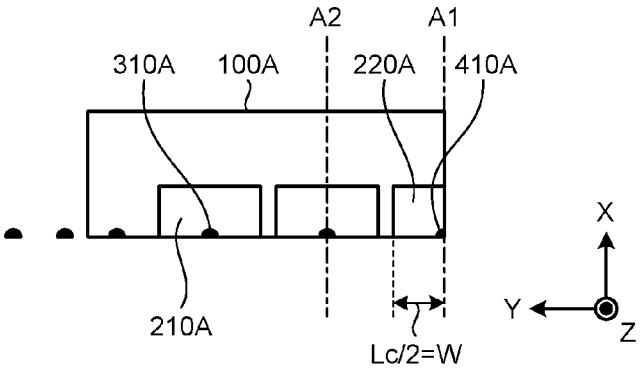
FIG. 2D is a diagram for describing an operation principle of the antenna device according to the first embodiment.

Then, as illustrated in FIG. 2D, the antenna device 10A is divided in half by a plane passing through the straight line A1. Since the antenna device 10A has a symmetric structure with respect to the straight line A1, the surface impedance of the antenna device 10A after divided is roughly Zs(f)/4.

Figure 2E:
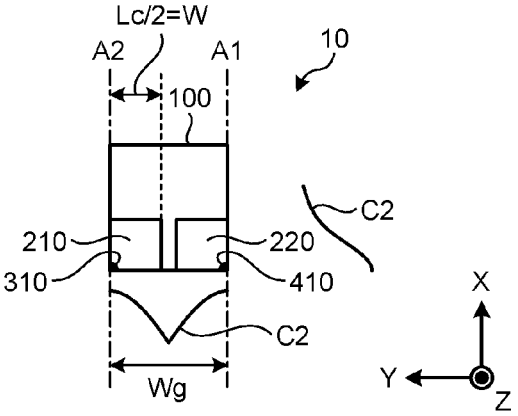
FIG. 2E is a diagram for describing an operation principle of the antenna device according to the first embodiment.

As illustrated in FIG. 2E, the antenna device 10A is further divided by a plane a straight line A2, and an antenna device 10 of a unit cell size is cut out of the antenna device 10A of the periodic structure. The straight line A2 is a straight line that passes through the conductor line 300A adjacent to the feed line 400A and is substantially parallel to the straight line A1.

Here, the current distribution of the antenna device 10 will be described. First, as illustrated in FIG. 2B, a current distribution C1 of the antenna device 10A is a distribution in which central portions of the conductor patches 210A and 220A are antinodes, and both end portions thereof are nodes.

When the antenna device 10 of the unit cell size is cut out of the antenna device 10A, an electric current flowing through the antenna device 10A is cut out at a position of the antinode. Therefore, a current distribution C2 flowing through the antenna device 10 illustrated in FIG. 2E is substantially equal to a current distribution obtained by cutting out ½ of a wavelength of from an antinode to an antinode in the current distribution C1 of the antenna device 10A illustrated in FIG. 2B.

Even when the antenna device 10 of the unit cell size is cut out of the antenna device 10A as described above, the current distribution C2 of the antenna device 10 keeps substantially the same period as the current distribution C1 of the antenna device 10A.

The impedance of the antenna device 10 is described. When the conductor patch 220A of the cut antenna device 10 of the unit cell size is directly excited, an input impedance Zin(f) of the antenna device 10 is about Zin(f)=Zs(f)/4 to Zs(f)/6.

In the antenna device 10, when an input impedance Zin(f0) is 50Ω at an operation frequency f0 (a wavelength λ0), in order to perform matching so that an input impedance Zin(f0) becomes 50Ω, the surface impedance Zs of the antenna device 10 preferably becomes Zs(f0)=200 to 300Ω.

When the operation frequency f0 and the center frequency fc of the antenna device 10 are set to a range of f0≤fc (λc≤λ0), the antenna device 10 satisfies a matching condition. Further, when a bandwidth of the antenna device 10 is considered, a range in which the matching condition is satisfied is roughly a range of fc/2≤f0. Therefore, a range of the center wavelength λc of the antenna device 10 that satisfies the matching condition is λ0/2≤λc≤λ0.

Since a phase condition that a phase is inverted in units of unit cells (a phase amount φ=π) is satisfied at the center frequency fc at which a stop band is obtained, an electric length of the unit cell of the antenna device 10A, that is, an electric length of the conductor patches 210A and 220A is λc/2 in principle.

Practically, when a phase delay caused in terms of a structure and an operation bandwidth in which the surface impedance Zs(f0) is 200 to 300Ω are considered, the physical length Lc of the conductor patches 210A and 220A is about λc/4. If it is applied to the range of λ0/2≤λc≤λ0 of the center wavelength λc, λ0/2≤4×Lc≤λ0, that is, λ0/8≤Lc≤λ0/4 is obtained.

Here, the length W of the sides 210*a* and 220*a* of the first and second conductor plates 210 and 220 of the antenna device 10 is a ½ of the length Lc of the conductor patches 210A and 220A (W=Lc/2). Therefore, the range of the length W of the sides 210*a* and 220*a* is λ0/8≤2×W≤λ0/4, that is, λ0/16≤W≤λ0/8.

As described above, in the antenna device 10 according to the present embodiment, the matching of the antenna device can be made by causing each of the lengths W of the sides 210*a* and 220*a* of the first and second conductor plates 210 and 220 to be substantially a ⅛ wavelength or less. Further, when the bandwidth of the antenna device 10 is considered, each of the lengths W of the sides 210*a* and 220*a* is preferably substantially a 1/16 wavelength or less.

As described above, the antenna device 10 is a small-sized antenna device in which matching is made so that the input impedance Zin(f0) is 50Ω, and the lengths W of the sides 210*a* and 220*a* are substantially a ⅛ wavelength or less.

Further, in the substrate of the mushroom type EBG structure, a height H of the substrate is a lower profile than an operation wavelength λ0 (H<<λc<λ0). Therefore, the height H of the antenna device 10 according to the present embodiment is a lower profile than the operation wavelength λ0.

As described above, in the antenna device 10 according to the present embodiment, the size of the antenna device can be reduced while securing a bandwidth at which impedance matching is made.

Further, since the first and second conductor plates 210 and 220 of the antenna device 10 are arranged to face the finite ground plane 100, the first and second conductor plates 210 and 220 do not protrude from a projection area of the finite ground plane 100. Therefore, for example, when the antenna device 10 is accommodated in a housing, the size of the housing can be reduced.

First Modified Example

Figure 3:
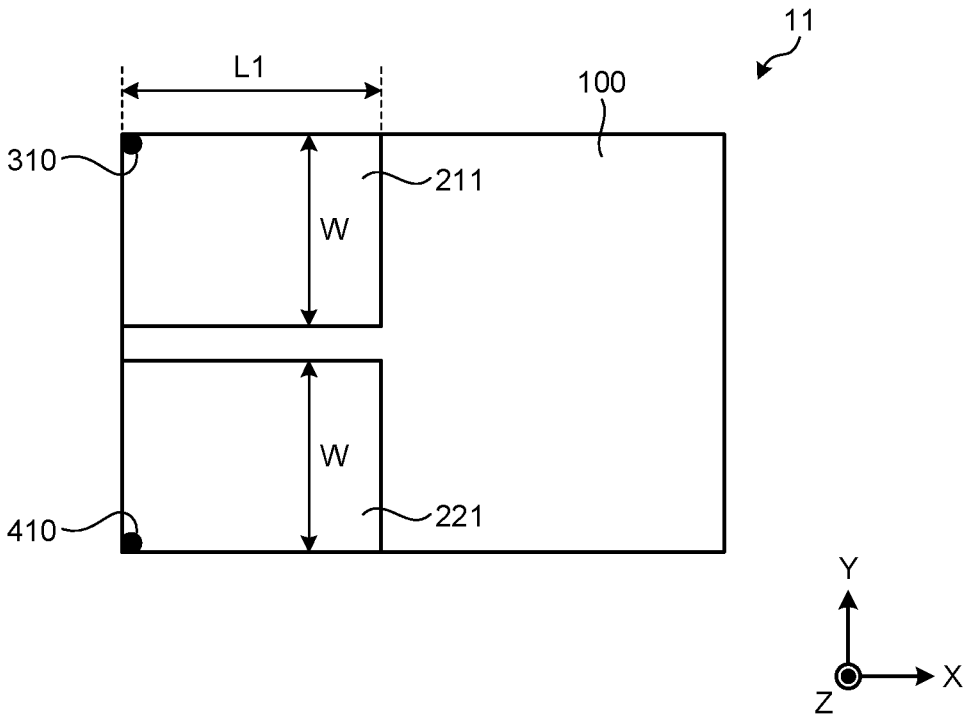
FIG. 3 is a diagram illustrating an antenna device according to a first modified example of the first embodiment.

A first modified example of the first embodiment will be described with reference to FIG. 3. An antenna device 11 illustrated in FIG. 3 is similar to the antenna device 10 except first and second conductor plates 211 and 221. The same components as in the first embodiment are denoted by the same reference numerals, and a description thereof is omitted.

The antenna device 11 according to the present modified example includes the first and second conductor plates 211 and 221. Each of the first and second conductor plates 211 and 221 is a rectangular conductor plate having a length L1 and a width W.

As described above, each of shapes of the first and second conductor plates 211 and 221 is not limited to a square but may be a rectangle. In this case, when the operation frequency f0 (the wavelength λ0) of the antenna device 11 is used, the length L1 and the width W preferably satisfy λ0/16≤W≤λ0/8 and λ0/16≤L1≤λ0/8.

In the present modified example, the lengths L1 of the first and second conductor plates 211 and 221 are larger than the width W (L1>W), but the width may be larger than the lengths L1 of the first and second conductor plates 211 and 221 (L1<W).

Second Embodiment

Figure 4A:
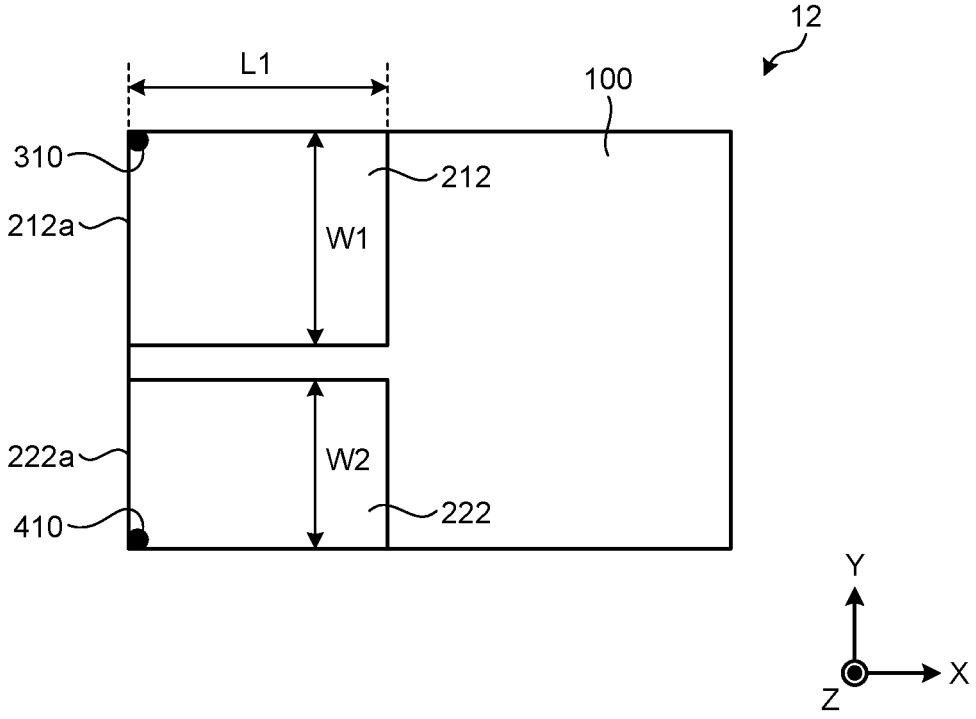
FIG. 4A is a diagram illustrating a configuration of an antenna device according to a second embodiment.
Figure 4B:
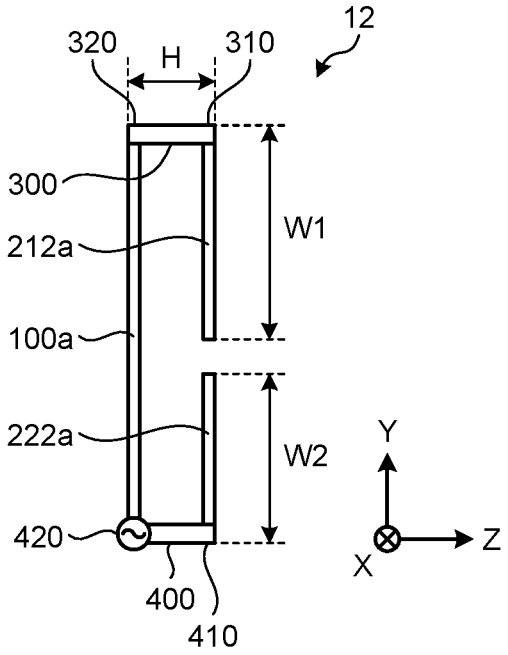
FIG. 4B is a diagram illustrating a configuration of an antenna device according to the second embodiment.

FIGS. 4A and 4B are diagrams illustrating a configuration of an antenna device 12 according to a second embodiment. FIG. 4A is a top view illustrating the antenna device 12 according to the present embodiment which is viewed in the Z-axis direction. FIG. 4B is a side view illustrating the antenna device 12 which is viewed in the X-axis direction. The same components as in the first embodiment are denoted by the same reference numerals, and a description thereof is omitted.

The antenna device 12 according to the present embodiment includes first and second conductor plates 212 and 222. The first conductor plate 212 is a rectangular conductor plate having a length L1 and a width W1. The first conductor plate 212 includes a linear side 212*a*. The side 212*a* is a side corresponding to the side 100*a* of the finite ground plane 100, and the length W1 satisfies $\lambda 0/16 \leq W1 \leq \lambda 0/8$ ($\lambda 0$ is the operation wavelength of the antenna device 12).

The second conductor plate 222 is a rectangular conductor plate having a length L1 and a width W2 (W2<W1). The second conductor plate 222 is a linear side 222*a*. The side 222*a* is a side corresponding to the side 100*a* of the finite ground plane 100, and the length W2 satisfies $\lambda 0/16 \leq W2 \leq \lambda 0/8$ ($\lambda 0$ is the operation wavelength of the antenna device 12). The lengths L1 of the first and second conductor plates 212 and 222 satisfy $\lambda 0/16 \leq L1 \leq \lambda 0/8$.

Next, an example in which the antenna device 12 is mounted in a wireless device 1 will be described with reference to FIGS. 5 and 6. Here, an example in which the antenna device 12 is mounted will be described, but the antenna devices 10 and 11 according to the first embodiment and the first modified example or an antenna device according to an embodiment to be described later may be mounted.

Figure 5:
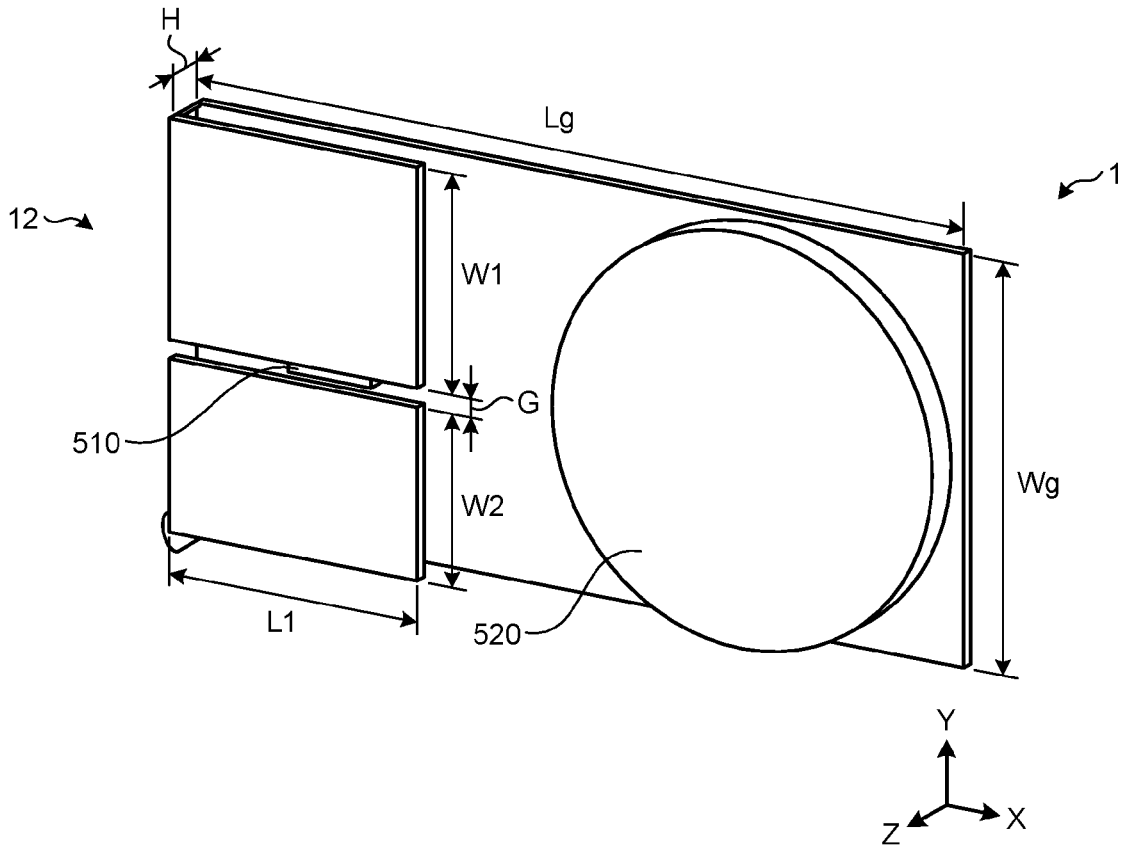
FIG. 5 is a diagram illustrating a configuration of a wireless device according to the second embodiment.
Figure 6:
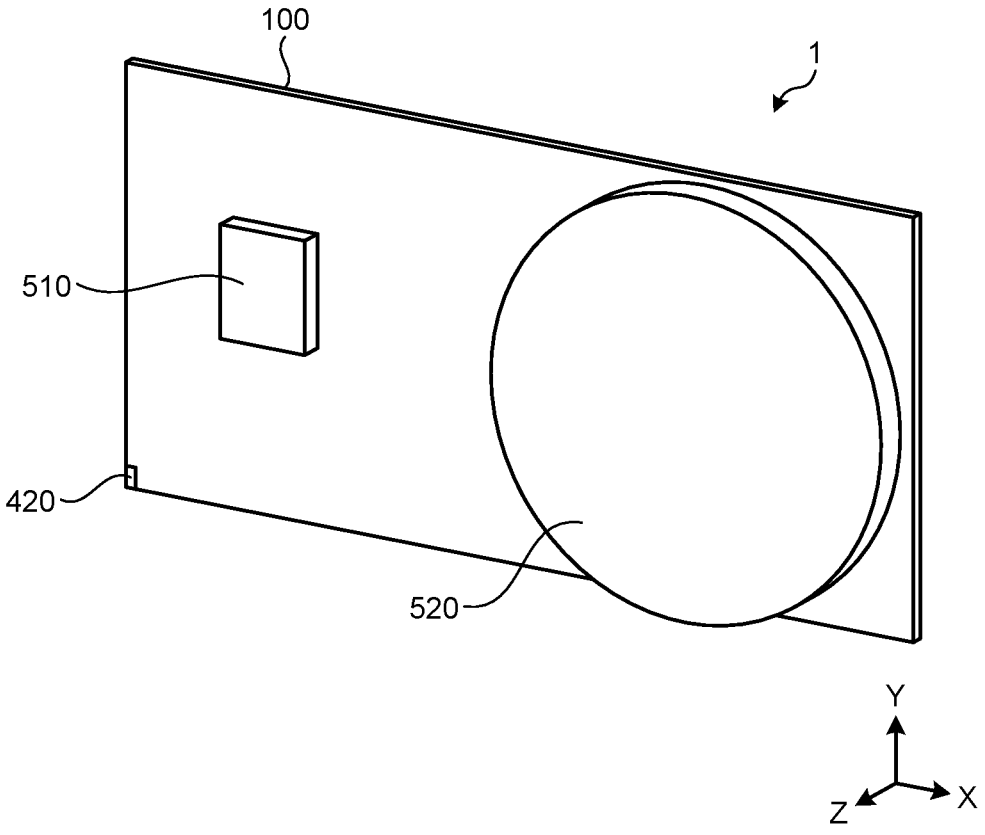
FIG. 6 is a diagram illustrating a configuration of a wireless device according to the second embodiment.

FIG. 5 is a perspective view of the wireless device 1, and FIG. 6 is a perspective view of the wireless device 1 excluding the first and second conductor plates 212 and 222, the conductor line 300, and the feed line 400.

The wireless device 1 includes the antenna device 12, a radio unit 510, and a battery 520 as illustrated in FIGS. 5 and 6.

The finite ground plane 100 of the antenna device 12 is configured with a common circuit substrate and operates a ground of the radio unit 510 or a circuit which is not illustrated.

The radio unit 510 is arranged on the finite ground plane 100. The radio unit 510 is arranged between at least one of the first and second conductor plates 212 and 222 and the finite ground plane 100. In the present embodiment, the radio unit 510 is arranged between the first and second conductor plates 212 and 222 and the finite ground plane 100.

The radio unit 510 is connected with a feed portion 420 of the antenna device 12 through a signal line (not illustrated) and performs wireless communication through the antenna device 12.

The battery 520 is arranged on the finite ground plane 100 and supplies electric power to the radio unit 510. In the present embodiment, the battery 520 is arranged on a portion of the finite ground plane 100 on which the first and second conductor plates 212 and 222 and the radio unit 510 are not arranged.

The battery 520 may supply electric power to any other circuit or device (not illustrated) as well as the radio unit 510. Alternatively, the battery 520 may not be arranged on the finite ground plane 100 and may be installed outside the wireless device 1.

Here, a reason why the radio unit 510 can be arranged between at least one of the first and second conductor plates 212 and 222 and the finite ground plane 100 will be described. It is because the antenna device 12 has a configuration in which the substrate of the unit cell size is cut out of the substrate of the EBG structure as described above in the first embodiment.

The substrate of the EBG structure has a features that an electric current hardly flows through the ground plane. Therefore, the antenna device 12 having the structure in which the substrate of the unit cell size is cut out of the substrate of the EBG structure also has a feature that an electric current hardly flows through the finite ground plane 100 as well.

In the antenna device according to the related art, a large electric current flows directly below the antenna, and thus it is difficult to arrange a circuit directly below the antenna. Therefore, it is necessary to individually arrange the antenna device and the circuit on the finite ground plane, and thus it is difficult to implement a small-sized compact wireless device.

On the other hand, the antenna device 12 according to the present embodiment has the feature that an electric current hardly flows through the finite ground plane 100 directly below the antenna, and thus a part that is influenced by an electric current such as the radio unit 510 can be mounted directly below the antenna, and thus a small-sized compact wireless device 1 can be implemented.

Figure 7:
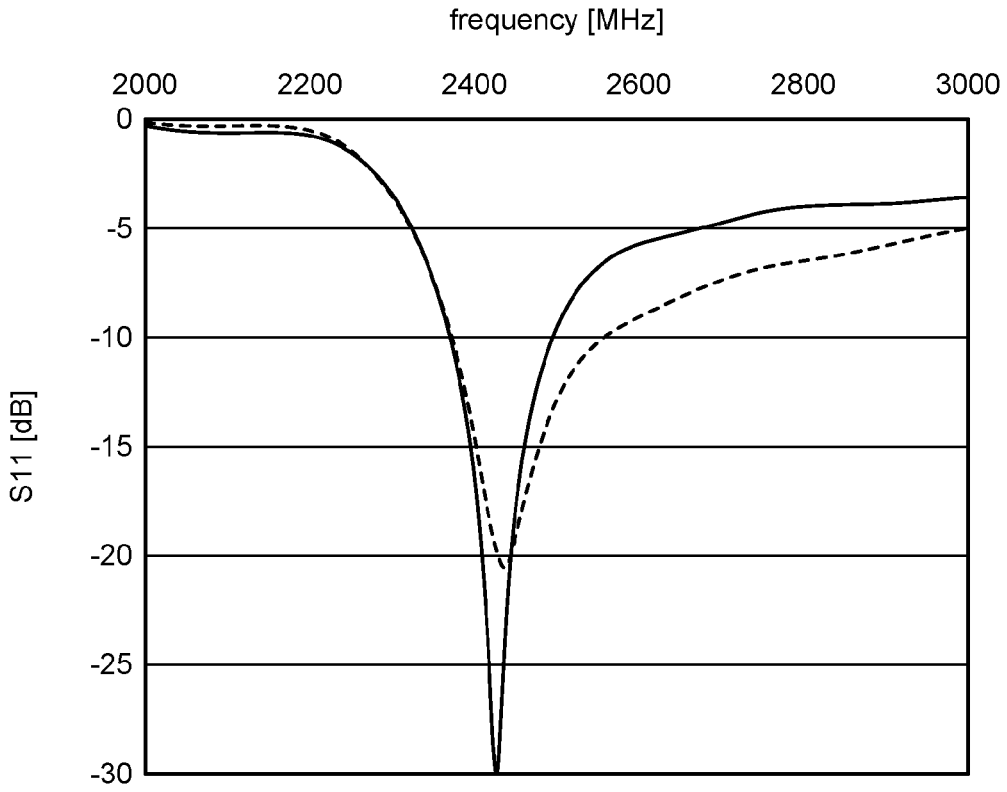
FIG. 7 is a diagram illustrating frequency characteristics of the wireless device according to the second embodiment.

Next, frequency characteristics of the wireless device 1 equipped with the antenna device 12 will be described with reference to FIGS. 7 and 8. FIG. 7 is a diagram illustrating a simulation result of the wireless device 1.

In FIG. 7, a dotted line indicates frequency characteristics of the wireless device 1 in a free space. In FIG. 7, a straight line indicates frequency characteristics of the wireless device 1 when the wireless device 1 is placed on a box-like phantom 600 simulated as a human body as illustrated in FIG. 8.

Here, the length Lg of the finite ground plane 100 is assumed to be Lg=40 mm, and the width Wg is assumed to be Wg=20 mm. The width W1 of the first conductor plate 212 is assumed to be W1=10.71 mm, and the width W2 of the second conductor plate 222 is assumed to be W2=8.64 mm.

The lengths L1 of the first and second conductor plates 212 and 222 is assumed to be L1=13 mm, the gap G is assumed to be G=0.65 mm, and the height H of the first and second conductor plates 212 and 222 is assumed to be H=2 mm. The center operation frequency f0 of the antenna device 12 is assumed to be f0=2450 MHz.

It is understood from the dotted line of FIG. 7 that matching of the antenna device 12 installed in the wireless device 1 is made near the center operation frequency f0 in the free space. As indicated by the straight line of FIG. 7, even when the phantom 600 is arranged at an opposite side to a plane on which the first and second conductor plates 212 and 222 of the finite ground plane 100 are arranged, matching is made near the center operation frequency f0.

As described above, in the antenna device 12 according to the present embodiment, a deviation between the center frequencies at which matching is made is small as can be apparent from a comparison of the frequency characteristics in the free space and the frequency characteristics when there is the phantom 600. Therefore, in the wireless device 1 according to the present embodiment, it is possible to reduce a variation in a matching characteristic caused by a change in a surrounding environment such as whether or not there is the phantom 600.

Figure 10A:
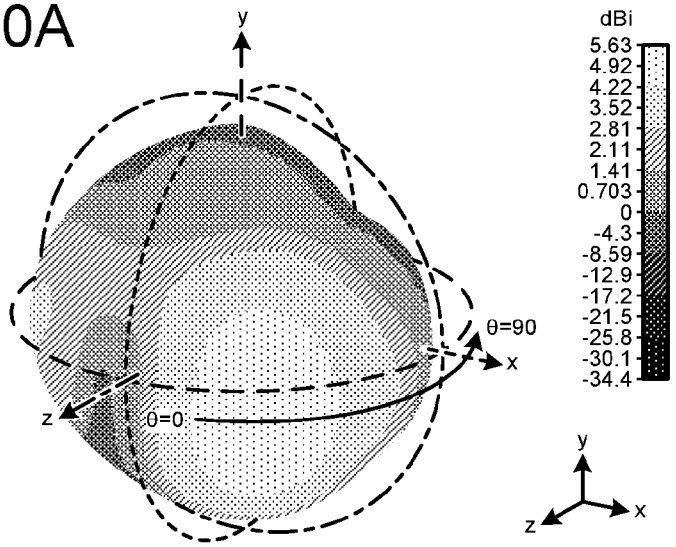
FIG. 10A is a diagram illustrating radiation characteristics of the wireless device according to the second embodiment.
Figure 10B:
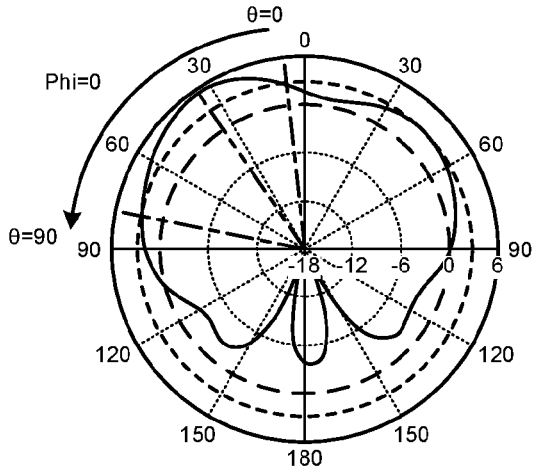
FIG. 10B is a diagram illustrating radiation characteristics of the wireless device according to the second embodiment.
Figure 10C:
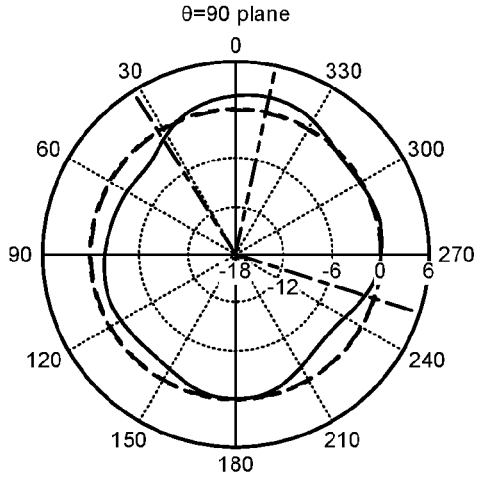
FIG. 10C is a diagram illustrating radiation characteristics of the wireless device according to the second embodiment.

Next, radiation characteristics of the wireless device 1 will be described with reference to FIGS. 9 to 10C. Dimensions and the operation frequency of the wireless device 1 are the same as when the frequency characteristics illustrated in FIG. 7 are measured.

Figures 8, 9:
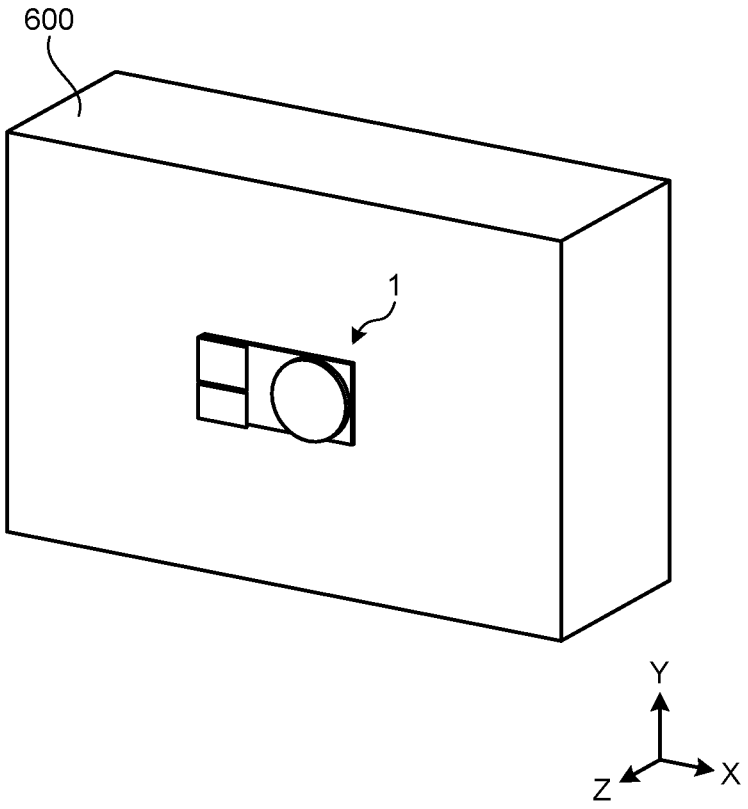
FIG. 8 is a diagram illustrating the wireless device according to the second embodiment.
FIG. 9 is a table illustrating radiation efficiency and directivity of the wireless device according to the second embodiment.

FIG. 9 is a table illustrating radiation efficiency and directivity. FIGS. 10A to 10C are diagrams illustrating a result of measuring the radiation characteristics of the wireless device 1 through a simulation.

FIG. 10A is a diagram illustrating radiation characteristics when there is the wireless device 1 on the phantom 600 as illustrated in FIG. 8. FIG. 10B is a diagram illustrating radiation characteristics on a plane ($\phi=0°$) passing through a dotted line of FIG. 10A. FIG. 10C is a diagram illustrating radiation characteristics on a plane ($\theta=90°$) passing through an alternate long and short dash line of FIG. 10A.

The radiation efficiency of the antenna device 12 of the wireless device 1 is −8.03 dB as illustrated in FIG. 9. It is understood from FIGS. 9 and 10 that a maximum directivity of the wireless device 1 has a maximum value of 5.63 dB from a direction vertical to the ground plane (a negative direction in the Z axis) toward a direction ($\theta\approx30°$) inclined to the X axis about 30°.

It is also understood from FIG. 9 that the maximum value of the maximum directivity on the plane of $\theta=90°$ is 1.94 dB, and an average value is −0.53 dB. Further, it is understood from FIG. 10C that radiation to the plane of $\theta=90°$, that is, the same plane as the finite ground plane 100 is good. It is because an electric current concentrates on the conductor line 300 and the feed line 400 substantially vertical to the finite ground plane 100, and the conductor line 300 and the feed line 400 function as a main radiation source.

As described above, since the wireless device 1 according to the present embodiment is small in size, and radiation to the same plane as the finite ground plane 100 is excellent, the wireless device 1 according to the present embodiment is suitable for an operation to human body surface (on-body) communication. This point is described with reference to FIG. 11.

Figure 11:
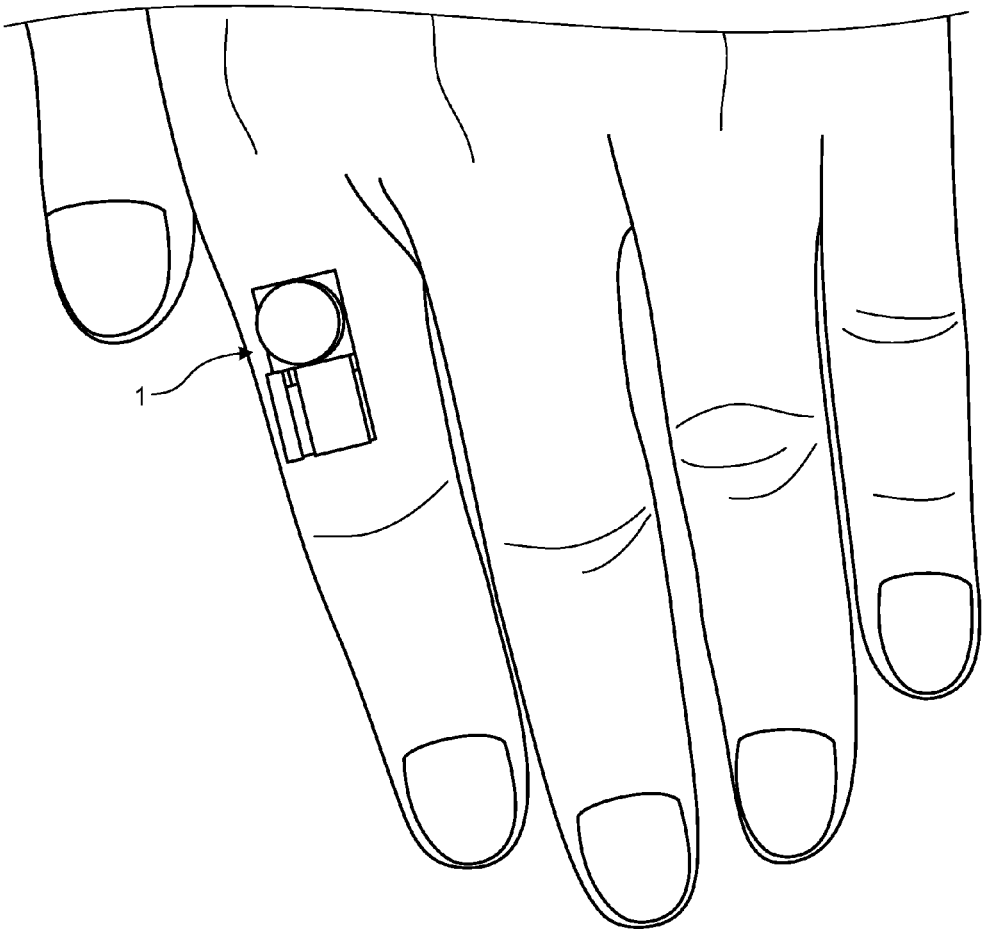
FIG. 11 is a diagram illustrating an example in which the wireless device according to the second embodiment is worn on a finger.

The on-body communication will be described using an example in which the wireless device 1 is worn on a finger as illustrated in FIG. 11. For example, the wireless device 1 is mounted on a ring (not illustrated), and the wireless device 1 is worn on the finger by putting a ring on the finger. Alternatively, the wireless device 1 may be worn on the finger using a belt.

The wireless device 1 worn on the finger is considered to perform communication with, for example, a wireless device 1 (not illustrated) worn on a chest. It is rare that the wireless devices 1 worn on the finger and the chest face each other while walking. On the other hand, when the wireless device 1 is worn on the chest, if a direction of a face of a person is considered to be substantially vertical to a plane including the finite ground plane 100, the wireless device 1 worn on the finger often passes through substantially the same plane as the finite ground plane 100. As described above, in the case of the on-body communication, the wireless devices 1 on substantially the same plane perform communication more often than in common wireless communication.

The wireless device 1 according to the present embodiment is small in size and thus easily mounted on a human body. Further, since the radiation to the same plane as the finite ground plane 100 is excellent, communication with another wireless device can be excellently performed even when the wireless device 1 is worn on the human body.

As described above, according to the antenna device 12 according to the present embodiment, the same effects as in the first embodiment can be obtained. Further, when the first and second conductor plates 212 and 222 have different widths W1 and W2, a phase delay amount caused by the sizes of the first and second conductor plates 212 and 222 can be adjusted. Accordingly, the impedance of the antenna device 12 can be adjusted.

When it is possible to adjust the impedance of the antenna device 12, for example, the antenna device 12 can be adjusted by arranging a circuit or the like nearby the antenna device 12 even when the matching condition has changed.

In the wireless device 1 according to the second embodiment, since the antenna device 12 is mounted, it is possible to downsize the wireless device 1 while securing a bandwidth at which impedance matching is made.

Further, since a circuit such as the radio unit 510 can be arranged between at least one of the first and second conductor plates 212 and 222 and the finite ground plane 100, it is possible to implement the small-sized compact wireless device 1.

In the present embodiment, the width W1 of the first conductor plate 212 of the antenna device 12 has been described as being larger than the width W2 of the second conductor plate 222 (W1>W2), but the width W1 of the first conductor plate 212 is preferably different from the width W2 of the second conductor plate 222. Therefore, the width W1 of the first conductor plate 212 may be smaller than the width W2 of the second conductor plate 222 (W1<W2).

Second Modified Example

Figure 12:
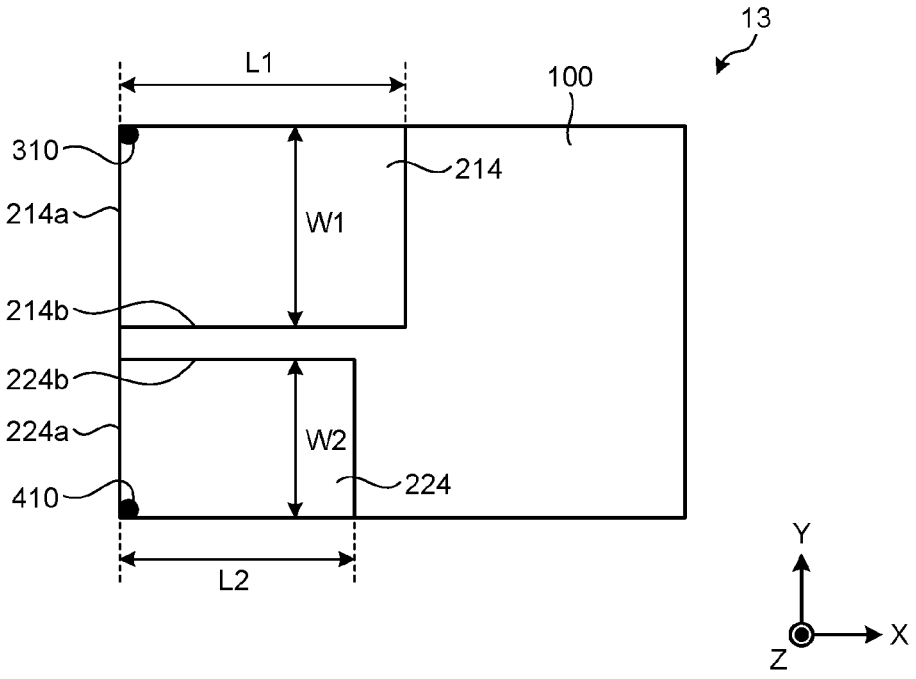
FIG. 12 is a diagram illustrating an antenna device according to a second modified example of the second embodiment.

FIG. 12 illustrates an antenna device 12 according to a second modified example of the second embodiment. In the antenna device 12 of the second embodiment, only the widths W1 and W2 of the first and second conductor plates 212 and 222 are different, but in an antenna device 13 according to the present modified example, lengths L1 and L2 of first and second conductor plates 214 and 224 are also different lengths. The remaining components are the same as in the second embodiment and denoted by the same reference numerals, and a description thereof is omitted.

The first conductor plate 214 is a rectangular conductor plate having a width W1 and a length L1 as illustrated in FIG. 12. The second conductor plate 224 is a rectangular conductor plate having a width W2 (W1>W2) and a length L2.

The length L1 of a side 214*b* of the first conductor plate 214 adjacent to the second conductor plate 224 is larger than the length L2 of a side 224*b* of the second conductor plate 224 adjacent to the first conductor plate 214. Here, a relation between the lengths L1 and L2 of the sides 214*b* and 224*b* is L1>L2 but may be L1<L2.

Since the lengths L1 and L2 as well as the widths W1 and W2 of the first and second conductor plates 214 and 224 are adjusted to be different for each other as described above, matching of the antenna device 13 can be easily made.

In the present modified example, both of the widths W1 and W2 and the lengths L1 and L2 of the first and second conductor plates 214 and 224 are different from each other, but the widths W1 and W2 may be equal, and the lengths L1 and L2 may be different.

Third Embodiment

Figure 13:
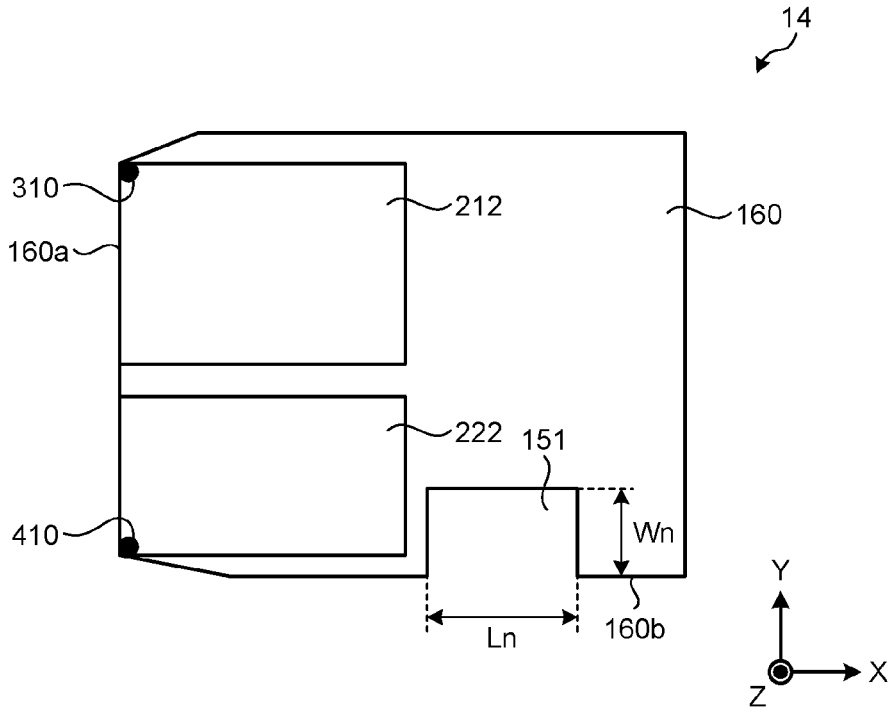
FIG. 13 is a diagram illustrating a configuration of a wireless device according to a third embodiment.

FIG. 13 illustrates an antenna device 14 according to a third embodiment. The antenna device 14 according to the present embodiment has a similar configuration to the antenna device 12 of the second embodiment except the shape of a finite ground plane 160, and thus the same components are denoted by the same reference numerals, and a description thereof is omitted.

The finite ground plane 160 of FIG. 13 has a polygonal shape having a linear side 160*a*. Specifically, the finite ground plane 160 has a hexagonal shape in which two adjacent corners are cut in a rectangular conductor plate. The finite ground plane 160 includes a notch 151 having a width Wn and a length Ln which is formed in the side 160*b*.

Here, an effect in that the finite ground plane 160 has a polygonal shape, or the notch is formed in the side will be described. The antenna device 14 performs transmission and reception of a radio wave by propagating a radio wave between the finite ground plane 160 and the first and second conductor plates 212 and 222. It is considered to be a state in which a radio wave is approximately propagated between two parallel plates.

Therefore, the dimensions of the first and second conductor plates 212 and 222 are relatively adjusted by adjusting the shape or the dimension of the finite ground plane 160. Accordingly, by adjusting the shape or the dimension of the finite ground plane 160, it is possible to adjust the phase delay amount of the first and second conductor plates 212 and 222 and adjust the impedance of the antenna device 14.

As described above, in the antenna device 14 according to the present embodiment, the same effects as in the second embodiment are obtained, and the impedance of the antenna device 14 can be adjusted by adjusting the shape of the finite ground plane 160.

The polygonal finite ground plane 160 in which all the sides have a linear shape is illustrated in FIG. 13, but the number or shapes of other sides are not consequential as long as the linear side 160*a* whose one end portion is connected to the conductor line 300, and the other end portion is connected to the feed line 400 is provided.

A side in which the notch 151 is formed is not limited to the side 160*b*. The notch 151 may be formed in any side except the linear side 160*a*. A plurality of notches 151 may be formed in the finite ground plane 160.

For example, there are cases in which various parts or circuits are mounted on the finite ground plane 160, or there are cases in which the finite ground plane 160 needs to have a non-rectangular shape due to manufacturing restrictions, and the finite ground plane 160 has electrical asymmetry.

In these cases, the impedance of the antenna device 14 can be adjusted by changing the dimensions of the first and second conductor plates 212 and 222 as in the other embodiments or the other modified examples.

As described above, by adjusting the shape and the dimension of the finite ground plane 160 or the first and second conductor plates 212 and 222, the impedance of the antenna device 14 can be adjusted, and thus a degree of design freedom of the antenna device 14 can be increased.

In the present embodiment, the example in which the shape of the finite ground plane 100 of the antenna device 12 according to the second embodiment is changed has been described, but the shape of the finite ground plane of the antenna device according to the other embodiments or the other modified examples may be similarly changed.

Fourth Embodiment

Figure 14:
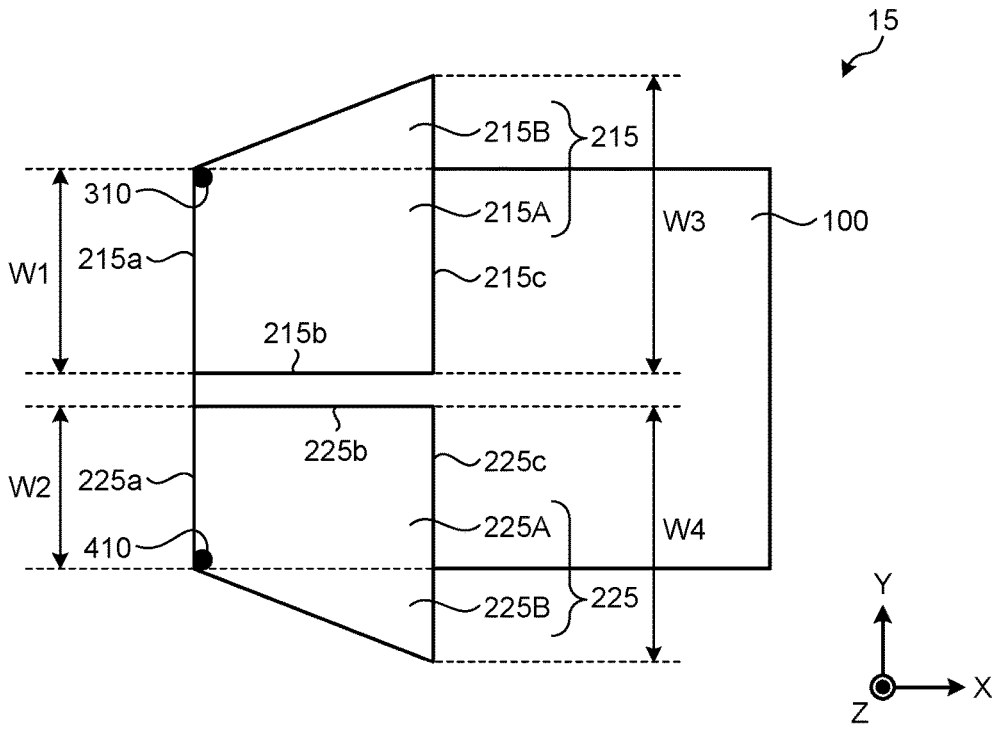
FIG. 14 is a diagram illustrating a configuration of a wireless device according to a fourth embodiment.

FIG. 14 illustrates an antenna device 15 according to a fourth embodiment. The antenna device 15 according to the present embodiment has a similar configuration to the antenna device according to the second embodiment except that first and second conductor plates 215 and 225 have taper portions 215B and 225B. Therefore, the same components as in the second embodiment are denoted by the same reference numerals, and a description thereof is omitted.

As illustrated in FIG. 14, in at least one of the first and second conductor plates 215 and 225, sides facing sides 215*b* and 225*b* which are adjacent to each other in the first and second conductor plates 215 and 225 are formed to be tapered.

Specifically, the first conductor plate 215 includes a rectangular conductor portion 215A and a right triangular taper portion 215B. The first conductor plate 215 includes a side 215*a* corresponding to the side 100*a* of the finite ground plane 100 and a side 215*c* facing the side 215*a*.

The taper portion 215B has a right triangular shape in which a side facing the side 215*b* of the rectangular conductor portion 215A is a bottom side, and a taper is an oblique side. The rectangular conductor portion 215A is the same as the first conductor plate 212 illustrated in FIG. 4, and thus a description thereof is omitted.

In the first conductor plate 215, one side of the rectangular conductor portion 215A and one side of the taper portion 215B constitute the side 215*c*. Therefore, the length W3 of the side 215*c* of the first conductor plate 215 is larger than the length W1 of the side 215*a* (W3>W1).

Next, the second conductor plate 225 includes a rectangular conductor portion 225A and a right triangular taper portion 225B. The second conductor plate 225 includes a side 225*a* corresponding to the side 100*a* of the finite ground plane 100 and a side 225*c* facing the side 225*a*.

The taper portion 225B has a right triangular shape in which a side facing the side 225*b* of the rectangular conductor portion 225A is a bottom side, and a taper is an oblique side. The rectangular conductor portion 225A is the same as the second conductor plate 222 illustrated in FIG. 4, and thus a description thereof is omitted.

In the second conductor plate 225, one side of the rectangular conductor portion 225A and one side of the taper portion 225B constitute the side 225*c*. Therefore, the length W4 of the side 225*c* of the second conductor plate 225 is larger than the length W2 of the side 225*a* (W4>W2).

The length W3 of the side 215*c* and the length W4 of the side 225*c* satisfy $\lambda 0/16 \leq W3 \leq \lambda 0/8$ and $\lambda 0/16 \leq W4 \leq \lambda 0/8$ for the operation frequency f0 (the wavelength $\lambda 0$) of the antenna device 15.

Figure 15:
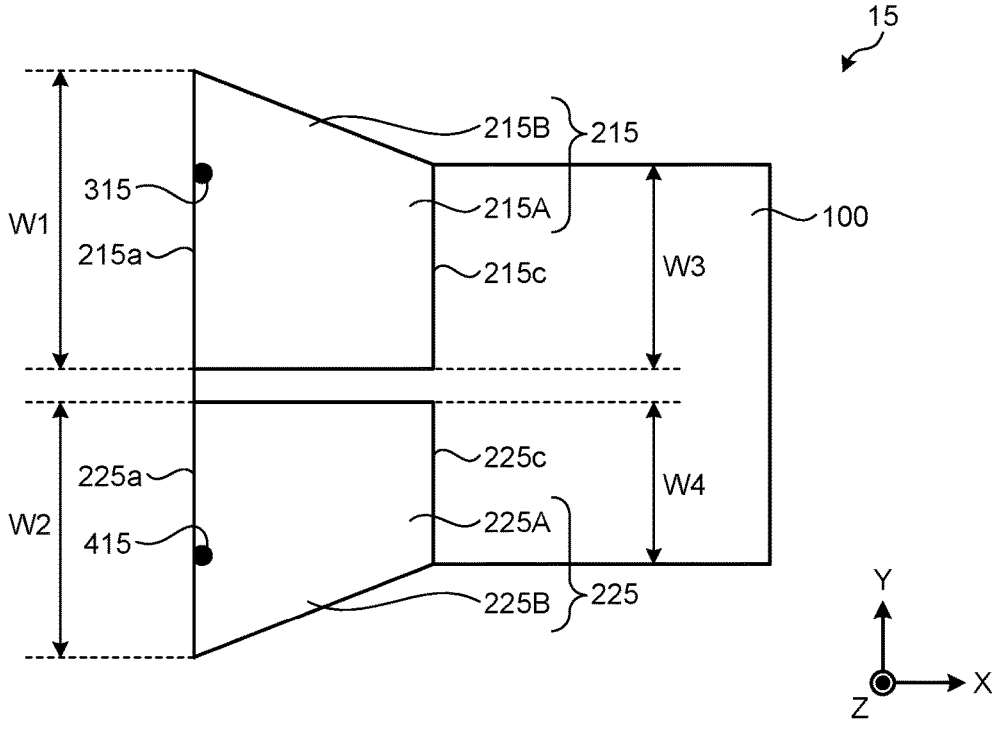
FIG. 15 is a diagram illustrating another example of the wireless device according to the fourth embodiment.

FIG. 15 illustrates another example of the antenna device 15 according to the fourth embodiment. As illustrated in FIG. 15, in the first and second conductor plates 215 and 225, one sides of the rectangular conductor portions 215A and 225A and one sides of the taper portions 215B and 225B constitute the sides 215*a* and 225*a*.

In this case, one end of the conductor line 300 is connected to a connection portion 315 on the side 215*a* rather than one end portion of the side 215*a*. Similarly, one end of the feed line 400 is connected to a connection portion 415 on the side 225*a* rather than one end portion of the side 225*a*.

As described above, the lengths W1 and W2 of the sides 215*a* and 225*a* are larger than the lengths W3 and W4 of the sides 215*c* and 225*c* (W1>W3, W2>W4).

Figure 16:
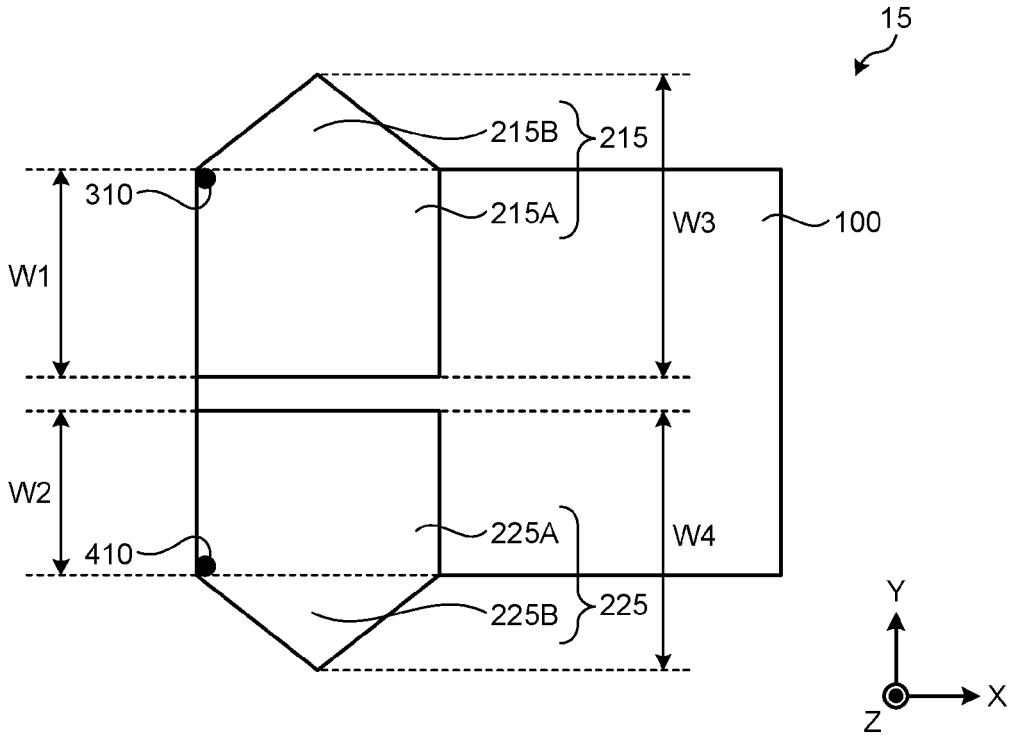
FIG. 16 is a diagram illustrating another example of the wireless device according to the fourth embodiment.

Next, FIG. 16 illustrates another example of the antenna device 15 according to the fourth embodiment. As illustrated in FIG. 16, each of the taper portions 215B and 225B of the first and second conductor plates 215 and 225 has two tapers.

As described above, a shape of each of the taper portions 215B and 225B is not limited to a right triangle and may be a triangle in which one side of each of the rectangular conductor portions 215A and 225A is a bottom side.

In this case, a length W3 from the side 215*b* of the first conductor plate 215 to an apex of the taper portion 215B is larger than a length W1 of the side 215*a* (W1<W3). Further, a length W4 from the side 225*b* of the second conductor plate 225 to an apex of the taper portion 225B is larger than a length W2 of the side 225*a* (W2<W4).

Each of the heights (W3−W1 and W4−W2) of the taper portions 215B and 225B is preferably about a 1/10 wavelength of the operation frequency or less.

As described above, in the antenna device 15 according to the fourth embodiment, the same effects as in the second embodiment are obtained, and the antenna device 15 with a broad band can be implemented by forming the taper portions 215B and 225B in the first and second conductor plates 215 and 225. It is because as the taper portions 215B and 225B are formed in the first and second conductor plates 215 and 225, the propagation state of the antenna device 15 becomes diverse, that is, the propagation mode is increased.

The rectangular conductor portions 215A and 225A and the taper portions 215B and 225B may be formed by connecting different conductor plates or may be integrally formed.

Third Modified Example

Figure 17:
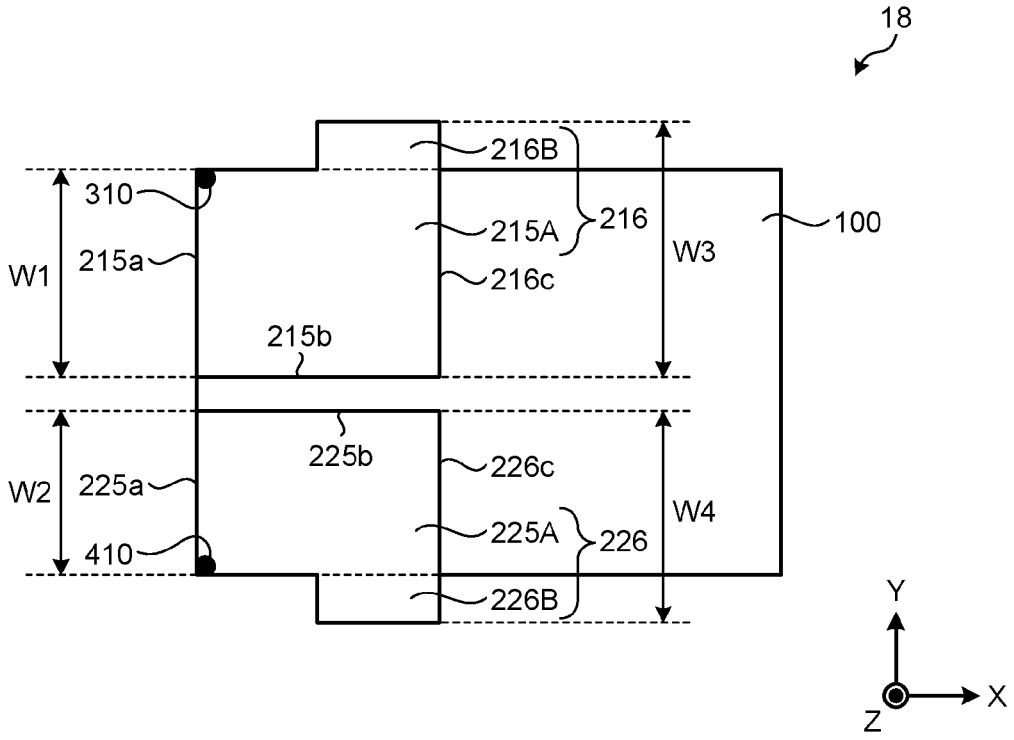
FIG. 17 is a diagram illustrating an antenna device according to a third modified example of the fourth embodiment.

FIG. 17 illustrates an antenna device 15 according to a third modified example of the fourth embodiment. An antenna device 18 illustrated in FIG. 17 is similar to the antenna device 15 except that first and second conductor plates 216 and 226 include rectangular convex portions 216B and 226B.

As illustrated in FIG. 17, in at least one of the first and second conductor plates 216 and 226, the convex portions 216B and 226B are formed at sides facing the sides 215*b* and 225*b* that are adjacent to each other in the first and second conductor plates 216 and 226.

The convex portion 216B of the first conductor plate 216 has a rectangular shape. In the first conductor plate 216, one side of the rectangular conductor portion 215A and one side of the convex portion 216B constitute a side 216*c*.

The convex portion 226B of the second conductor plate 226 has a rectangular shape. In the second conductor plate 226, one side of the rectangular conductor portion 225A and one side of the convex portion 226B constitute a side 226*c*.

As described above, even when the rectangular convex portions 216B and 226B are used instead of the triangular taper portions 215B and 225B, the antenna device 18 with a broad band can be implemented.

In the present modified example, the convex portions 216B and 226B are formed at the sides 216*c* and 226*c* but may be formed at the sides 215*a* and 225*a* or may be installed at the center.

Fourth Modified Example

Figure 18:
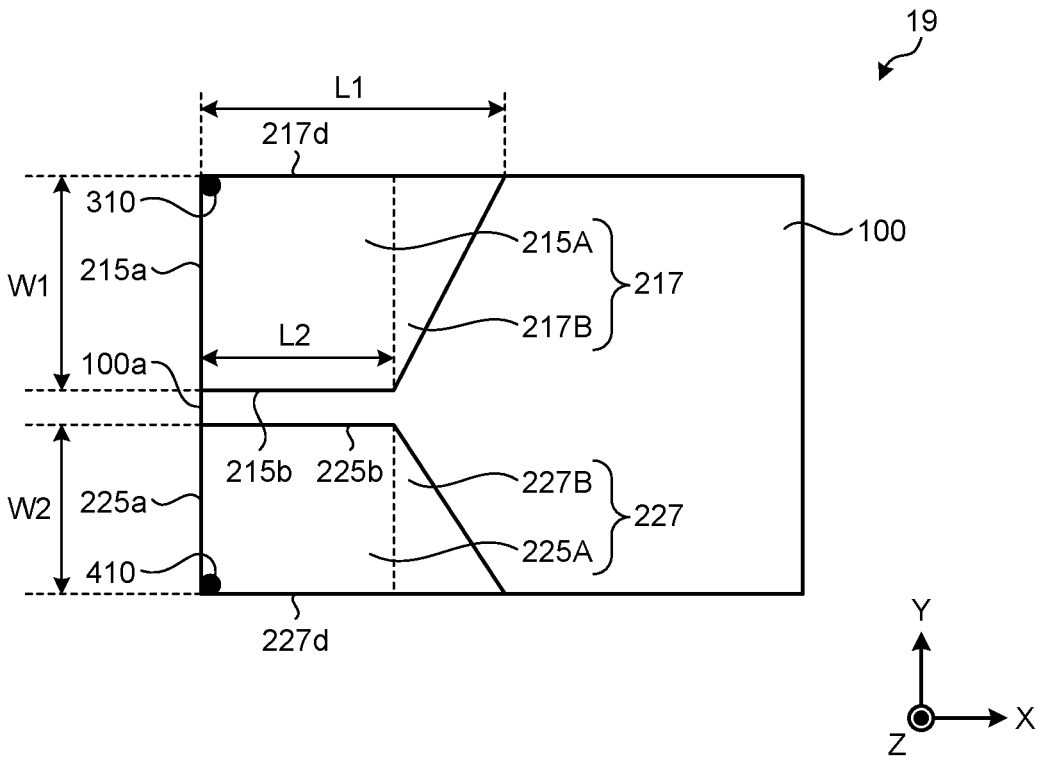
FIG. 18 is a diagram illustrating an antenna device according to a fourth modified example of the fourth embodiment.

FIG. 18 illustrates an antenna device 15 according to a fourth modified example of the fourth embodiment. An antenna device 19 illustrated in FIG. 18 is a similar to the antenna device 15 except that first and second conductor plates 217 and 227 include triangular taper portions 217B and 227B.

As illustrated in FIG. 18, in at least one of the first and second conductor plates 217 and 227, a taper is formed at sides facing the sides 215*a* and 225*a* of the first and second conductor plates 215 and 225 corresponding to the side 100*a*.

The taper portion 217B of the first conductor plate 217 has a right triangular shape. In the first conductor plate 217, one side of the rectangular conductor portion 215A and one side of the taper portion 217B constitute a side 217*d*.

The taper portion 227B of the second conductor plate 227 has a right triangular shape. In the second conductor plate 227, one side of the rectangular conductor portion 225A and one side of the taper portion 227B constitute a side 227*d*.

In this case, the lengths L1 of the sides 217*d* and 227*d* of the first and second conductor plates 217 and 227 are larger than the lengths L2 of the sides 215*b* and 225*b* (L1>L2). The heights (L1−L2) of the taper portions 217B and 227B are preferably about a 1/10 wavelength of the operation frequency or less.

The lengths L2 of the sides 215*b* and 225*b* that are adjacent to each other in the first and second conductor plates 217 and 227 may be larger than the lengths L1 of the sides 217*d* and 227*d* facing the sides 215*b* and 225*b* (L1<L2).

Figure 19:
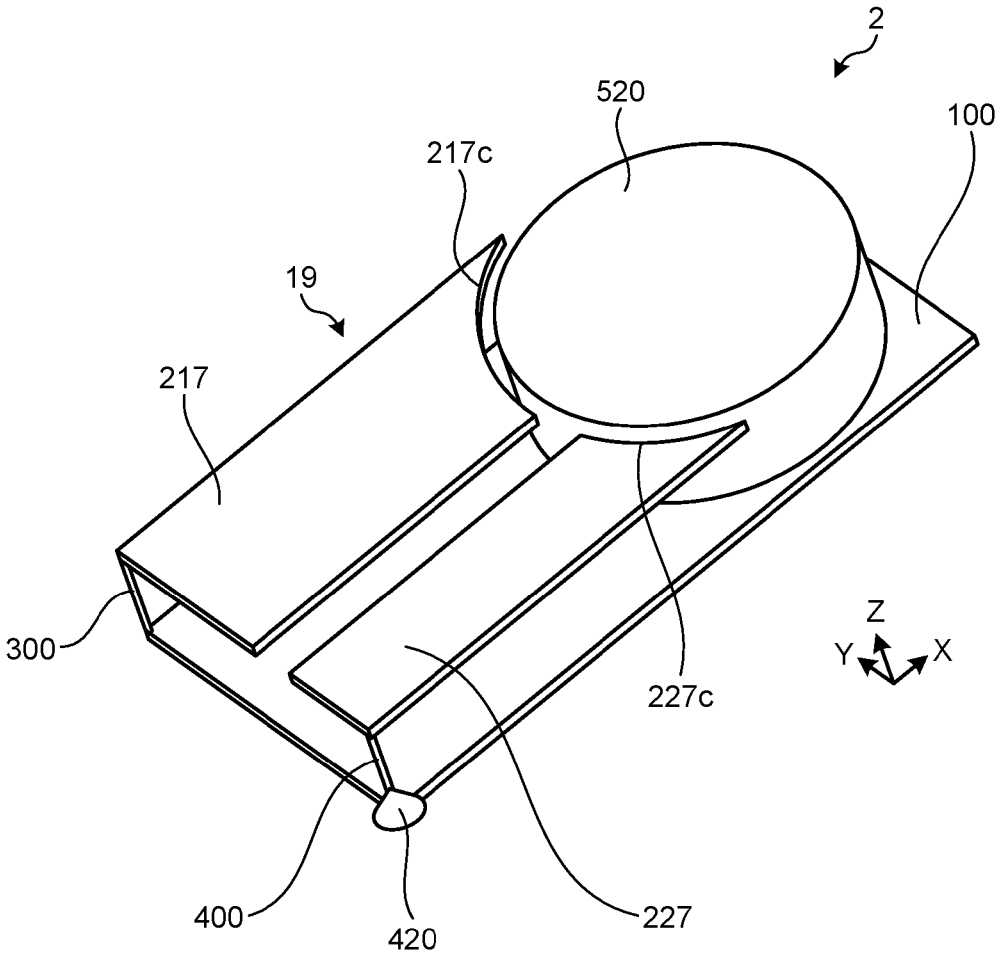
FIG. 19 is a diagram illustrating the antenna device according to the fourth modified example of the fourth embodiment.

The taper portions 217B and 227B are not limited to a triangular shape. Tapers 217*c* and 227*c* may be curved lines as illustrated in FIG. 19. The same applies to the taper portions 215B and 225B of the antenna devices 15 illustrated in FIGS. 14 to 16. Further, the sides of the convex portions 216B and 226B illustrated in FIG. 17 may be curved lines.

FIG. 19 illustrates an example in which a wireless device 2 including a battery 520 is equipped with the antenna device 19. In FIG. 19, the tapers 217*c* and 227*c* have curved lines along the shape of the battery 520. As described above, the shapes of the first and second conductor plates 217 and 227 can be adjusted according to a shape of a part mounted in the wireless device 2. Although not illustrated in FIG. 19, the wireless device 2 may include a circuit portion such as the radio unit 510.

The taper portions 215B, 217B, 225B, and 227B or the convex portions 216B and 226B may be formed in only either of the first conductor plate 215 to 217 and the second conductor plate 225 to 227.

The shapes of the taper portions 215B, 217B, 225B, and 227B or the convex portions 216B and 226B are not limited to the above-described examples. The first conductor plates 215 to 217 may have any shape as long as the side 215*a* corresponding to the linear side 100*a* of the finite ground plane 100 is provided, and an internal contact is made with a rectangular shape having a length L1 and a width W1.

The second conductor plates 225 to 227 may have any shape as long as the side 225*a* corresponding to the linear side 100*a* of the finite ground plane 100 is provided, and an internal contact is made with a rectangular shape having a length L2 and a width W2. All of L1, L2, W1, and W2 are a 1/16 wavelength of the operation frequency or more and a 1/8 wavelength or less.

Fifth Embodiment

Figure 20A:
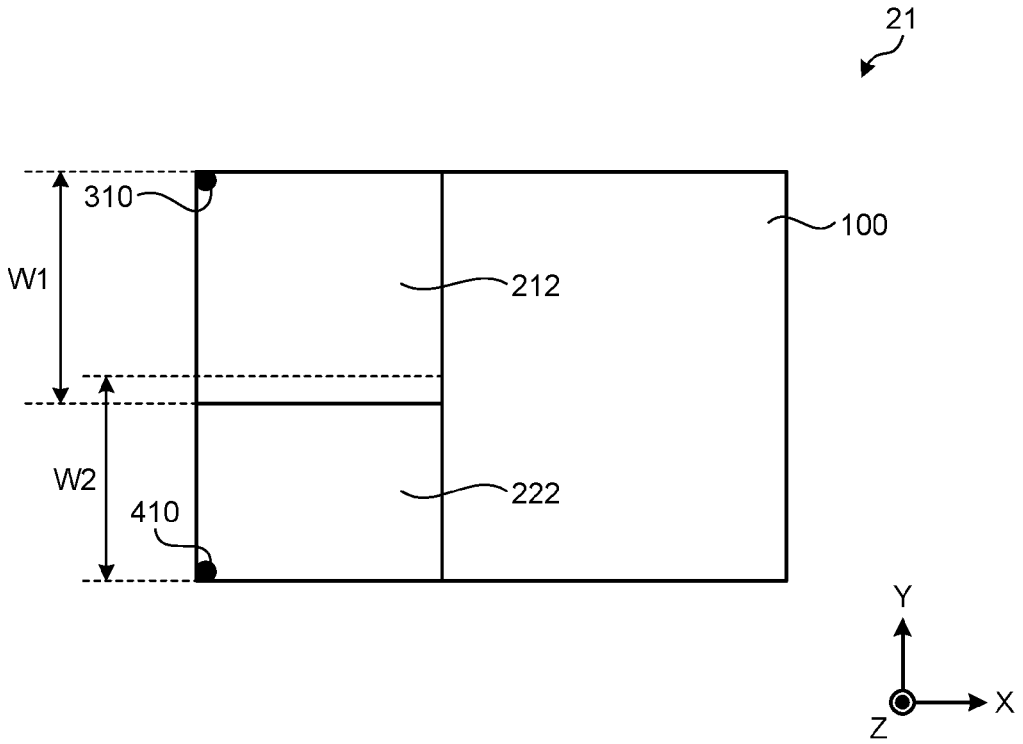
FIG. 20A is a diagram illustrating a configuration of an antenna device according to a fifth embodiment.
Figure 20B:
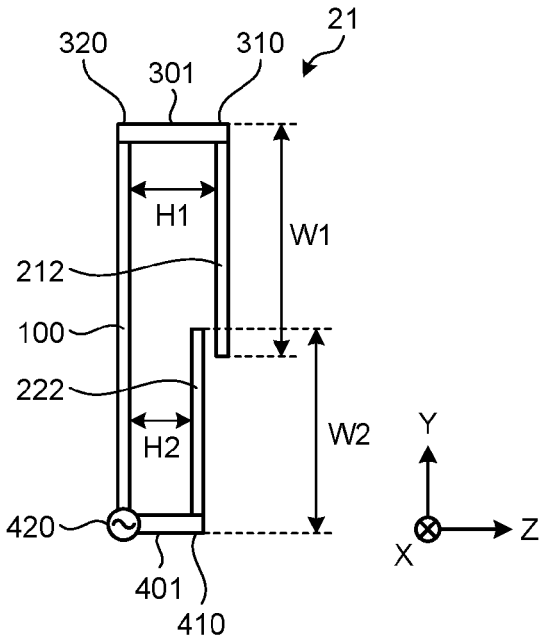
FIG. 20B is a diagram illustrating a configuration of the antenna device according to the fifth embodiment.

FIGS. 20A and 20B illustrate an antenna device 21 according to a fifth embodiment. The antenna device 21 according to the present embodiment has a similar configuration to the antenna device according to the second embodiment except a conductor line 301 and a feed line 401. Therefore, the same components as in the second embodiment are denoted by the same reference numerals, and a description thereof is omitted.

Here, FIG. 20A is a top view illustrating the antenna device 21 according to the present embodiment which is viewed in the Z-axis direction. FIG. 20B is a side view illustrating the antenna device 21 which is viewed in the X-axis direction.

The antenna device 21 includes the conductor line 301 and the feed line 401 which differ in a length as illustrated in FIGS. 20A to 20B. In the present embodiment, the conductor line 301 is a line having a length H1, and the feed line 401 is a line having a length H2 (H1>H2).

The conductor line 301 and the feed line 401 are connected to be substantially orthogonal to the finite ground plane 100. Therefore, the heights of the first and second conductor plates 212 and 222 from the finite ground plane 100 are substantially equal to the lengths H1 and H2 of the conductor line 301 and the feed line 401, respectively. Therefore, the height H1 of the first conductor plate 212 is higher than the height H2 of the second conductor plate 222.

Here, in the antenna device 10 illustrated in FIGS. 1A to 1C, the second conductor plate 220 and the first conductor plate 210 are arranged to be adjacent to each other in the Y-axis direction with a gap G therebetween, and the first and second conductor plates 212 and 222 are arranged to be adjacent to each other so that capacitive coupling is performed.

On the other hand, in the present embodiment, as illustrated in FIGS. 20A and 20B, the height H1 of the first conductor plate 212 is set to be different from the height H2 of the second conductor plate 222, and the first conductor plate 212 and the second conductor plate 222 are arranged to be adjacent to each other in the Z-axis direction with the gap G (G=H1−H2).

As described above, capacitive coupling between the first and second conductor plates 212 and 222 can be enhanced by arranging the first and second conductor plates 212 and 222 to partially overlap when viewed in the Z-axis direction.

As described above, in the antenna device 21 according to the present embodiment, the same effects as in the second embodiment are obtained, and a capacitive coupling property between the first and second conductor plates 212 and 222 can be enhanced by setting the height H1 of the first conductor plate 212 to be different from the height H2 of the second conductor plate 222.

The size of the antenna device 21 can be further reduced by enhancing the capacitive coupling property between the first and second conductor plates 212 and 222.

The antenna device 21 has a multi-layer structure, and the first and second conductor plates 212 and 222 are formed on different layers, and thus the antenna device 21 including the first and second conductor plates 212 and 222 that differ in height can be manufactured.

In this case, the capacitive coupling property between the first and second conductor plates 212 and 222 can be adjusted with a high degree of accuracy by appropriately selecting a dielectric constant and a thickness of a dielectric serving as a base material of the multi-layer structure.

In the present embodiment, the example in which the height H1 of the first conductor plate 212 is higher than the height H2 of the second conductor plate 222 has been described, but the height H2 of the second conductor plate 222 may be higher than the height H1 of the first conductor plate 212 (H2>H1).

In the present embodiment, the heights of the first and second conductor plates 212 and 222 of the antenna device 12 are set to be different, but heights of the first and second conductor plates of other antenna devices may be set to be different.

Sixth Embodiment

Figure 21:
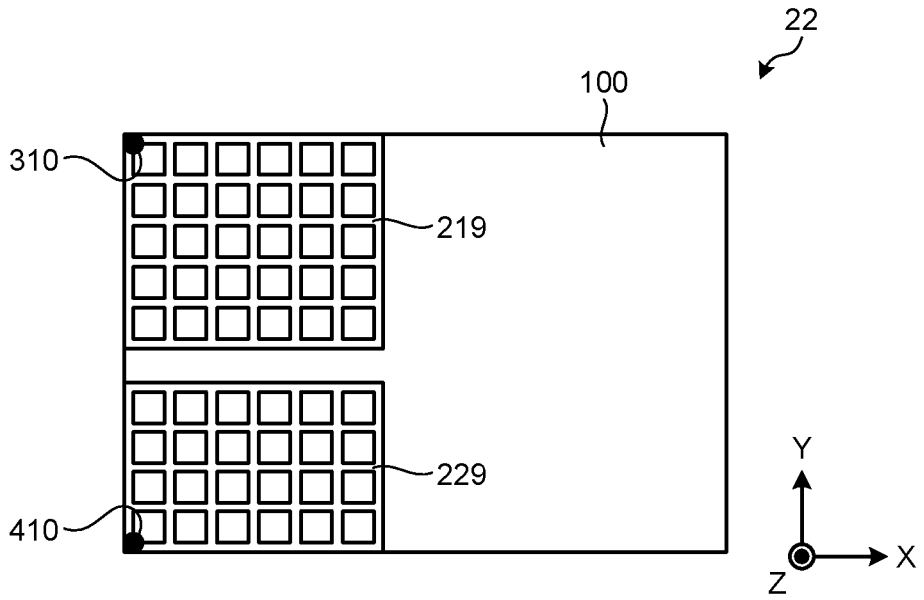
FIG. 21 is a diagram illustrating a configuration of an antenna device according to a sixth embodiment.

FIG. 21 illustrates an antenna device 22 according to a sixth embodiment. The antenna device 22 according to the present embodiment has a similar configuration as the antenna device according to the second embodiment except the first and second conductor plates 219 and 229. Therefore, the same components as in the second embodiment are denoted by the same reference numerals, and a description thereof is omitted.

The first and second conductor plates 219 and 229 are mesh-like plates as illustrated in FIG. 21. Specifically, the first and second conductor plates 219 and 229 include a plurality of rectangular gaps arranged in a matrix form.

As described above, when the mesh-like gaps are formed in the first and second conductor plates 219 and 229, a path of an electric current flowing through the first and second conductor plates 219 and 229 is restricted. Accordingly, an inductive property of the antenna device 22 is increased, and a capacitive property between the first and second conductor plates 219 and 229 and the finite ground plane 100 is reduced. The antenna device 22 with the broad band can be implemented according to an increase in the inductive property and a decrease in the capacitive property.

When the heights of the first and second conductor plates 219 and 229 from the finite ground plane 100 are reduced, the bandwidth of the antenna device 22 is reduced. However, in the antenna device 22 according to the present embodiment, since the broadband can be implemented as described above, it is possible to secure a desired bandwidth even when the heights of the first and second conductor plates 219 and 229 from the finite ground plane 100 are small.

As described above, in the antenna device 22 according to the present embodiment, the same effects as in the second embodiment are obtained, and the antenna device 22 with the broad band can be implemented by employing the mesh-like plate as the first and second conductor plates 219 and 229. Further, it is possible to cause the antenna device 22 to have a low profile.

As illustrated in FIG. 21, in the present embodiment, rectangular gaps arranged in a 5×6 matrix form are formed in the first conductor plate 219, and gaps arranged in a 4×6 matrix form are formed in the second conductor plate 229, but the number of gaps and the shape of the gap are not limited thereto.

In the first and second conductor plates 219 and 229, gaps may be formed in an n×m matrix form (n and m are integers of 2 or more), and gaps may be formed in a 1×m matrix form or an n×1 matrix form. Alternatively, various shapes such as a polygonal shape or a circular shape may be sued as the shape of the gap.

In the present embodiment, both of the first and second conductor plates 219 and 229 are mesh-like plates, but one of the first and second conductor plates 219 and 229 may be a mesh-like plate.

In the present embodiment, a plurality of gaps are formed in the first and second conductor plates 210 and 220 of the antenna device 12, and the mesh-like plate is used for the first and second conductor plates 210 and 220, but the mesh-like plate may be used for the first and second conductor plates of other antenna devices.

Seventh Embodiment

Figure 22:
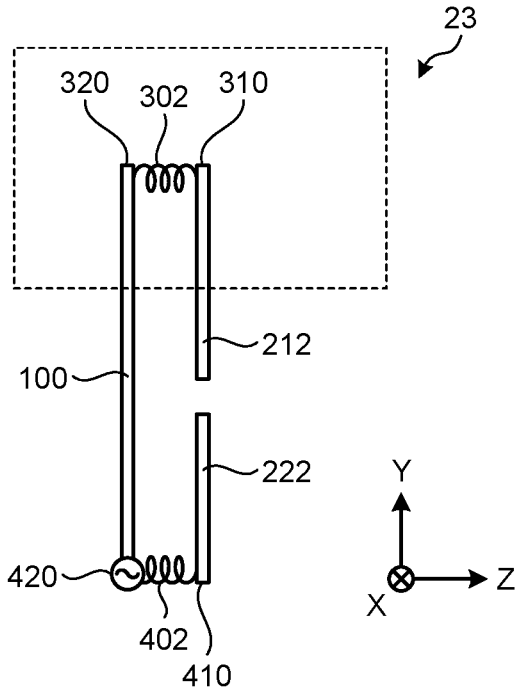
FIG. 22 is a diagram illustrating a configuration of an antenna device according to a seventh embodiment.

FIG. 22 illustrates an antenna device 23 according to a seventh embodiment. The antenna device 23 according to the present embodiment has a similar configuration to the antenna device according to the second embodiment except a conductor line 302 and a feed line 402. Therefore, the same components as in the second embodiment are denoted by the same reference numerals, and a description thereof is omitted.

As illustrated in FIG. 22, the conductor line 302 and the feed line 402 are formed in a helical form. When the conductor line 302 and the feed line 402 are formed in the helical form as described above, the inductive property of the conductor line 302 and the feed line 402 increases. Since the inductive property of the conductor line 302 and the feed line 402 increases, the antenna device 23 with the broad band or the low profile can be implemented.

Figure 23:
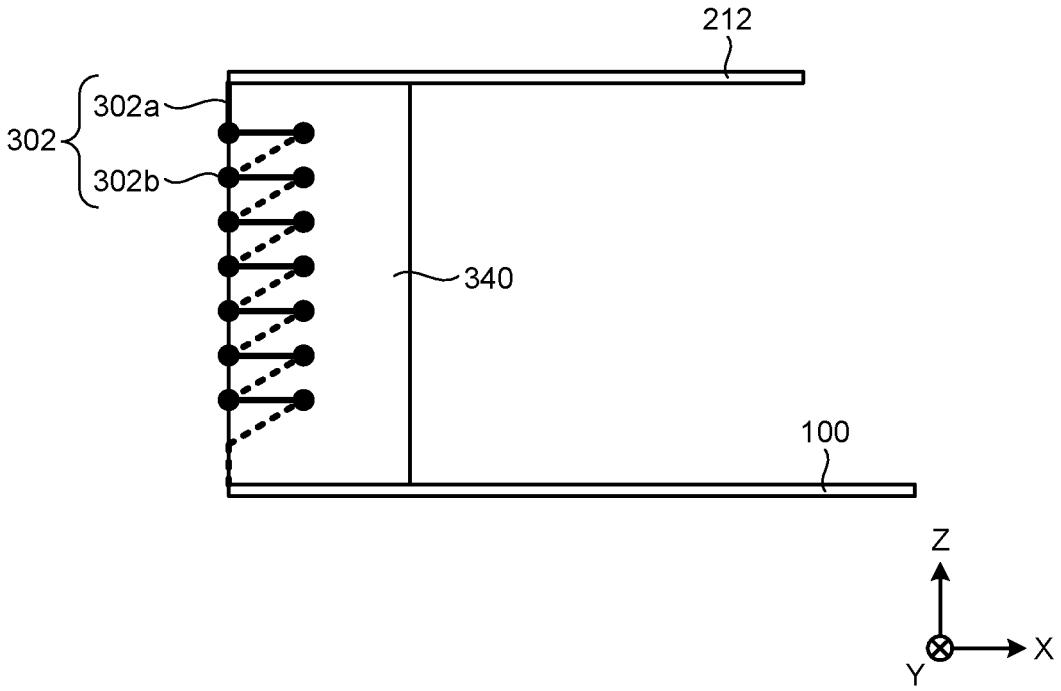
FIG. 23 is an enlarged view illustrating the antenna device according to the seventh embodiment.

FIG. 23 is an enlarged view illustrating a portion surrounded by a dotted line in FIG. 22. The antenna device 23 illustrated in FIG. 23 includes the conductor line 302 configured with a conductive line 302*a* and a through hole 302*b* and a dielectric 340. The dielectric 340 is arranged between the finite ground plane 100 and the first conductor plate 212. The dielectric 340 has a thickness equal to a length of one side of a helical form.

Next, an example in which the conductor line 302 and the feed line 402 are formed in the helical form will be described with reference to FIG. 23. Here, a method of forming the conductor line 302 is described later, and the feed line 402 may be similarly formed.

First, the conductive line 302*a* indicated by a straight line in FIG. 23 is patterned on one surface of the dielectric 340. Here, the conductive line 302*a* is patterned by etching a conductive foil formed on one surface of the dielectric 340. Similarly, the conductive line 302*a* indicated by a dotted line in FIG. 23 is patterned on the other surface facing one side of the dielectric 340.

Then, the conductive line 302*a* formed on one surface of the dielectric 340 and the conductive line 302*a* formed on the other surface are electrically connected through the through hole 302*b*. Accordingly, the conductor line 302 of the helical square form can be formed on the dielectric 340. Here, a method of forming the conductive line 302*a* has been described by the etching, but the conductive line 302*a* may be formed by printing on the surface of the dielectric 340 using conductive ink.

Figure 24:
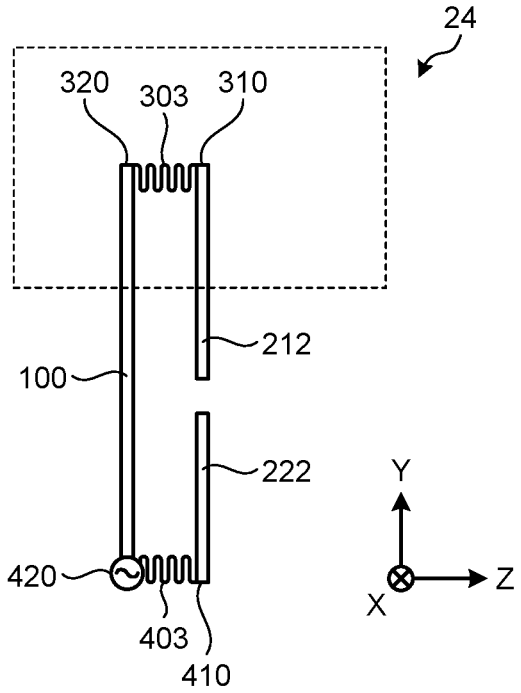
FIG. 24 is a diagram illustrating a configuration of the antenna device according to the seventh embodiment.

The conductor line 302 and the feed line 402 may be formed in a meander. FIG. 24 is a diagram illustrating an antenna device 24 including a conductor line 303 and a feed line 403 which are formed in the meander form.

Even when the conductor line 303 and the feed line 403 are formed in the meander form as illustrated in FIG. 24, it is possible to increase the inductive property of the conductor line 303 and the feed line 403 and implement the antenna device 24 with the broad band or the low profile.

Figure 25:
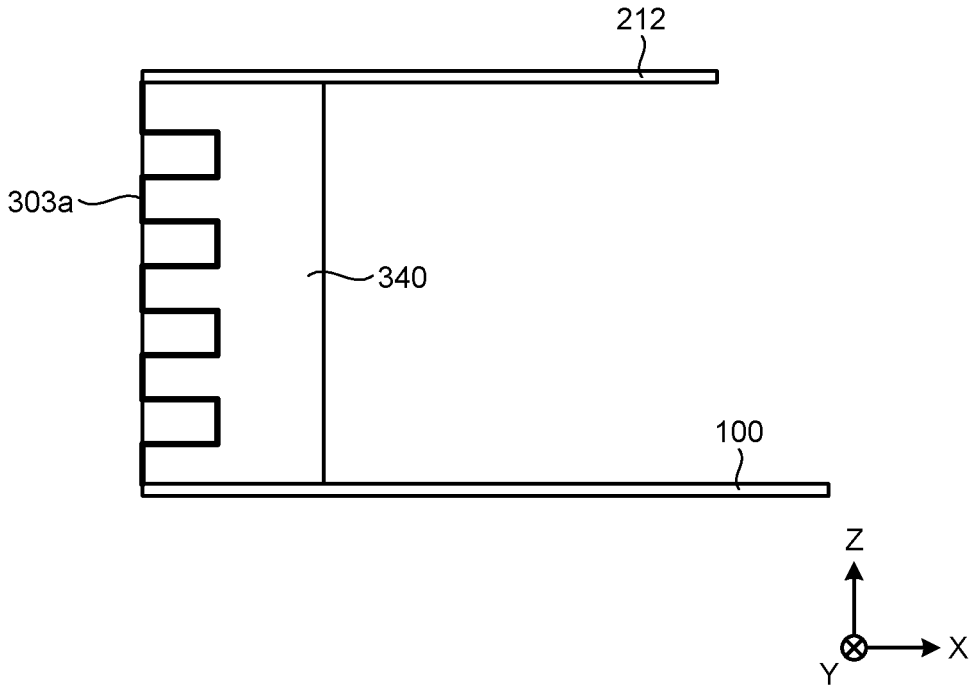
FIG. 25 is an enlarged view illustrating the antenna device according to the seventh embodiment.

FIG. 25 is an enlarged view illustrating a portion surrounded by a dotted line in FIG. 24. The antenna device 23 illustrated in FIG. 23 includes the conductor line 303 configured with a conductive line 303*a* and the dielectric 340. The dielectric 340 is arranged between the finite ground plane 100 and the first conductor plate 212.

The conductive line 303*a* is formed by etching on a conductive foil formed on one surface of the dielectric 340. Alternatively, the conductive line 303*a* is formed by printing on one surface of the dielectric 340 using conductive ink.

As described above, in the antenna devices 23 and 24 according to the present embodiment, the same effects as in the second embodiment are obtained, and the antenna devices 23 and 24 with the broad band or the low profile can be implemented by forming the conductor lines 302 and 303 and the feed lines 402 and 403 in the helical form or the meander form.

In the present embodiment, the example in which the conductive lines 302*a* and 303*a* are patterned on the dielectric 340 has been described, but the conductor lines 302 and 303 and the feed lines 402 and 403 may be formed by any other method. In this case, the antenna devices 23 and 24 need not necessarily include the dielectric 340.

In the present embodiment, both of the conductor lines 302 and 303 and the feed lines 402 and 403 are formed in the helical form or the meander form, but either of the conductor lines 302 and 303 and the feed lines 402 and 403 may be formed in the helical form or the meander form.

In the present embodiment, the example in which the conductor line 300 and the feed line 400 of the antenna device 12 are formed in the helical form or the meander form has been described, but the conductor line and feed line of other antenna devices may be formed in the helical form or the meander form.

Eighth Embodiment

An example of a method of manufacturing an antenna device 25 will be described with reference to FIGS. 26A to 27D. In the present embodiment, a method of manufacturing the antenna device 25 that operates similarly to the antenna device 12 is described, but other antenna devices may be similarly manufactured.

Figure 26A:
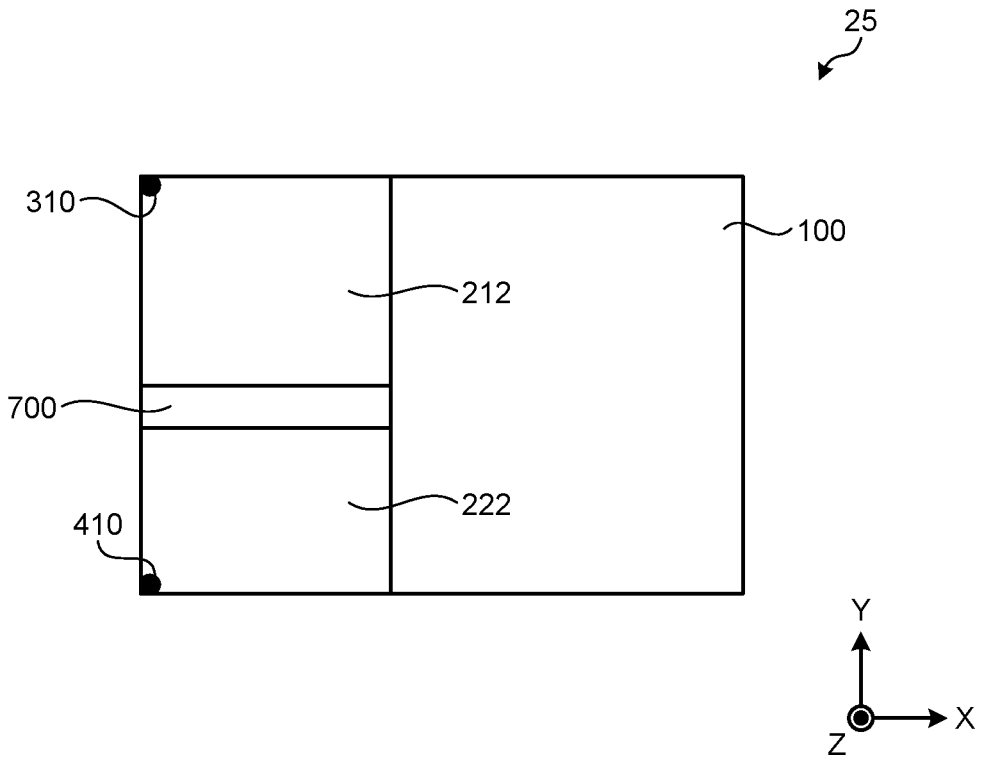
FIG. 26A is a diagram illustrating a configuration of an antenna device according to an eighth embodiment.
Figure 26B:
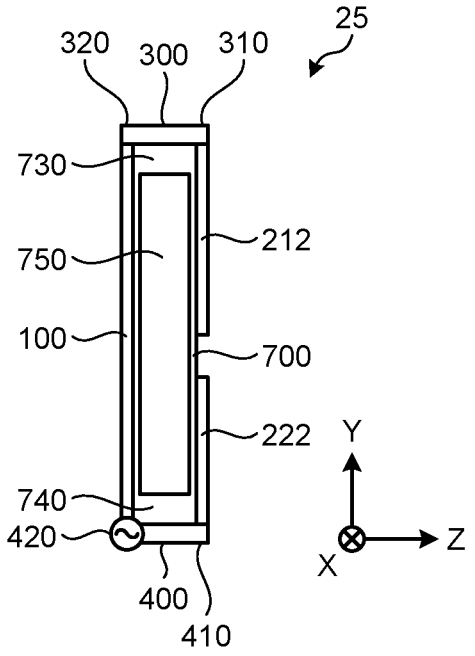
FIG. 26B is a diagram illustrating a configuration of the antenna device according to the eighth embodiment.
Figure 26C:
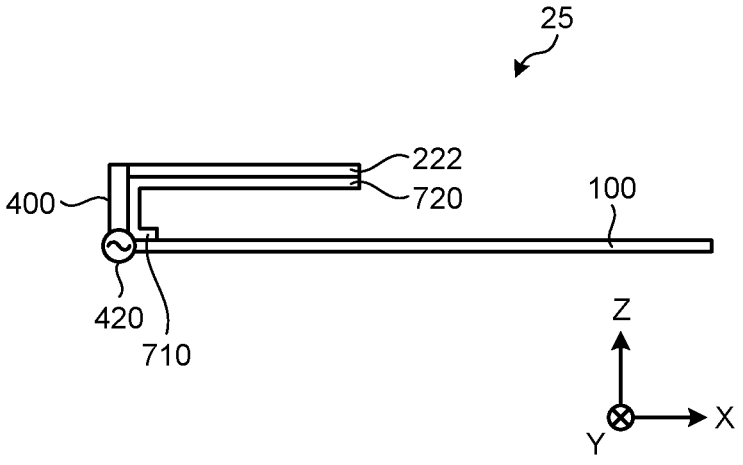
FIG. 26C is a diagram illustrating a configuration of the antenna device according to the eighth embodiment.

FIG. 26 is a diagram illustrating the antenna device 25 manufactured by a manufacturing method according to the present embodiment. Here, FIG. 26A is a top view illustrating the antenna device 25 which is viewed in the Z-axis direction. FIG. 26B is a side view illustrating the antenna device 25 which is viewed in the X-axis direction, and FIG. 26C is a side view illustrating the antenna device 25 which is viewed in the Y-axis direction.

As illustrated in FIG. 26, the antenna device 25 includes a flexible substrate 700 in addition to the configuration of the antenna device 11 illustrated in FIG. 4. A hole 750 is formed in the flexible substrate 700. The flexible substrate 700 includes first to fourth substrates 710 to 740 arranged to surround the hole 750.

The first substrate 710 of the flexible substrate 700 is connected to the finite ground plane 100. The first and second conductor plates 212 and 222 are formed on the second substrate 720 using a metallic film. The conductor line 300 is formed on the third substrate 730 using a metallic film, and the feed line 400 is formed on the fourth substrate 740 using a metallic film.

As described above, in the antenna device 25 according to the present embodiment, the first and second conductor plates 212 and 222, the conductor line 300, and the feed line 400 are formed on the flexible substrate 700 using the metallic film.

Figure 27A:
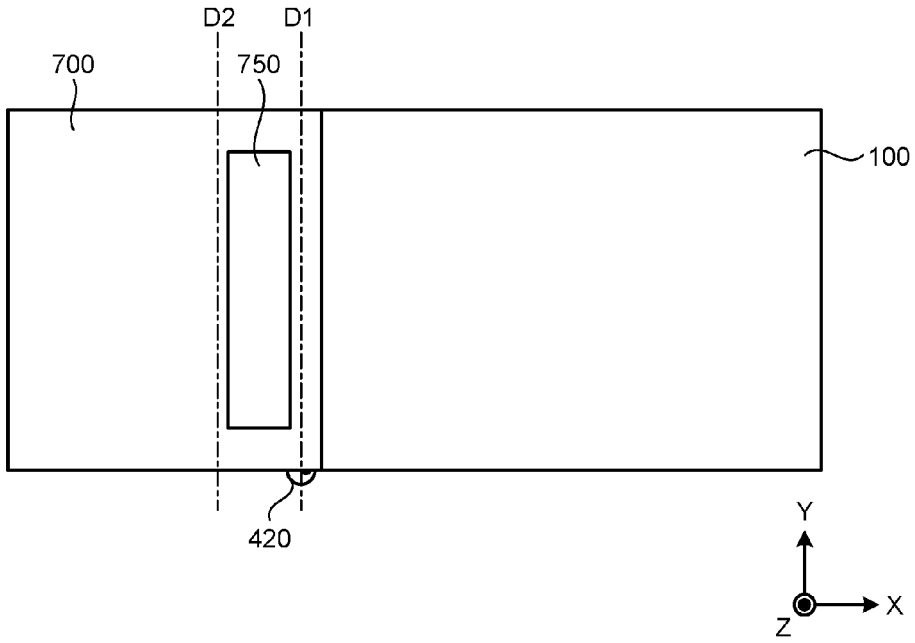
FIG. 27A is a diagram illustrating a method of manufacturing an antenna device according to the eighth embodiment.
Figure 27B:
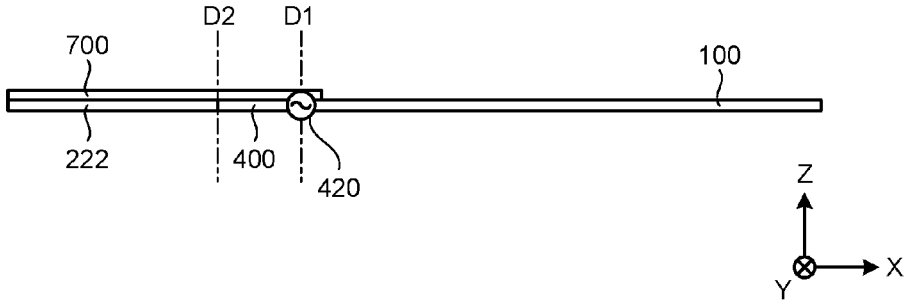
FIG. 27B is a diagram illustrating the method of manufacturing the antenna device according to the eighth embodiment.

Next, a method of manufacturing the antenna device 25 will be described with reference to FIGS. 27A to 27D. First, the finite ground plane 100 are connected to the first substrate 710 of the flexible substrate 700 as illustrated in FIG. 27A.

Then, the first and second conductor plates 212 and 222 are formed on the second substrate 720. When the flexible substrate 700 has a single layer, the first and second conductor plates 212 and 222 are formed on one surface of the second substrate 720. Alternatively, the first conductor plate 212 may be formed on one surface of the second substrate 720, and the second conductor plate 222 may be formed on the other surface facing one surface.

When the flexible substrate 700 has two or more layers, the first and second conductor plates 212 and 222 may be formed on an inner layer of the second substrate 720. In this case, the first and second conductor plates 212 and 222 may be formed on the same layer or may be formed on different layers. FIGS. 27A to 27D illustrate an example in which the first and second conductor plates 212 and 222 are formed on one surface of the second substrate 720.

Next, the conductor line 300 is formed on the third substrate 730 to be connected with the ground of the finite ground plane 100. The feed line 400 is formed on the fourth substrate 740 to be connected with the radio unit (not illustrated) arranged on the finite ground plane 100 at the feed point 420 via the signal line.

The process of forming the first and second conductor plates 212 and 222, the conductor line 300, and the feed line 400 and the processing of connecting the finite ground plane 100 need not be necessarily performed in the above-described order. For example, the first and second conductor plates 212 and 222, the conductor line 300, and the feed line 400 may be collectively and simultaneously formed through the same process. After the first and second conductor plates 212 and 222, the conductor line 300, and the feed line 400 are formed, the finite ground plane 100 may be connected with the flexible substrate 700.

Figure 27C:
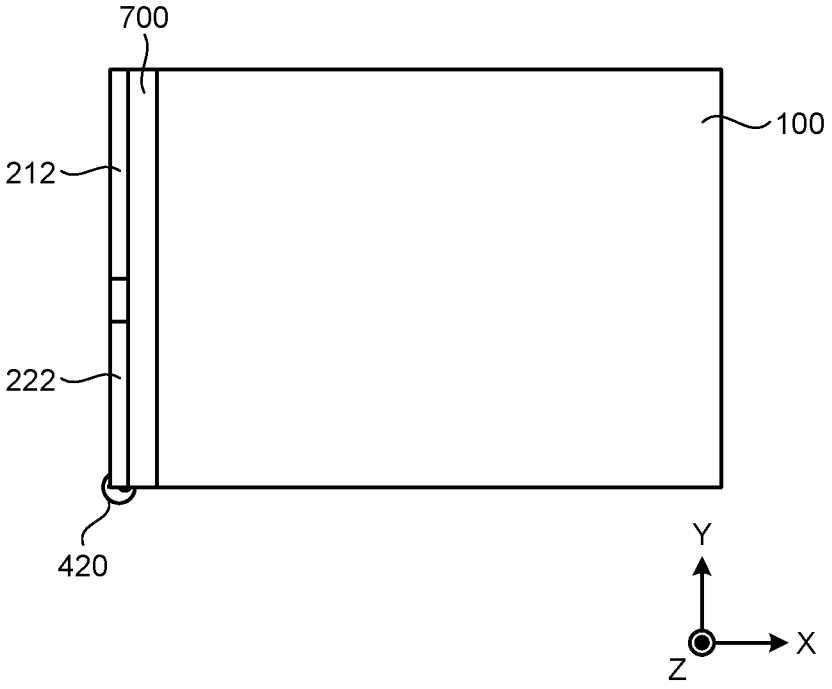
FIG. 27C is a diagram illustrating the method of manufacturing the antenna device according to the eighth embodiment.
Figure 27D:
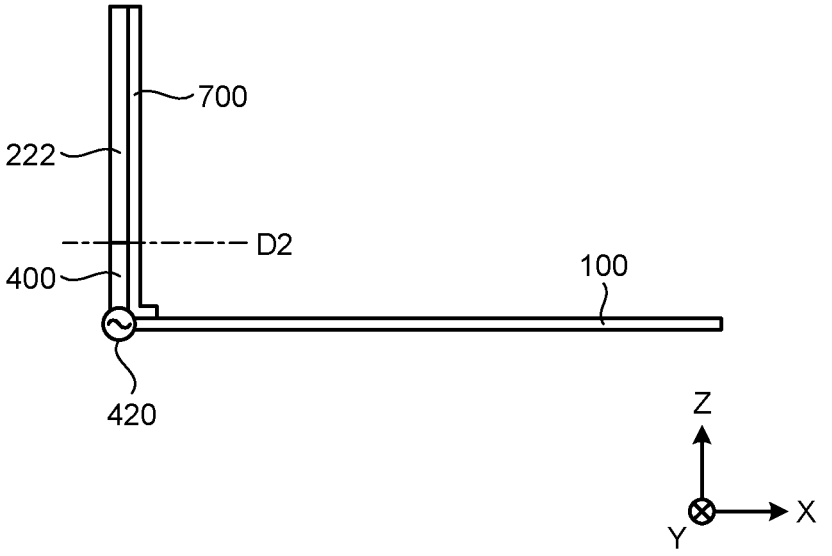
FIG. 27D is a diagram illustrating the method of manufacturing the antenna device according to the eighth embodiment.

Then, as illustrated in FIGS. 27C and 27D, the flexible substrate 700 is folded and bent along an alternate long and short dash line D1 at substantially a right angle. The side 100*a* of the finite ground plane 100 (see FIG. 4) is arranged along the alternate long and short dash line D1. Here, therefore, the flexible substrate 700 is folded and bent along the side 100*a* of the finite ground plane 100 to substantially a right angle.

Thereafter, the flexible substrate 700 is folded and bent along an alternate long and short dash line D2 at substantially right angle so that the first and second conductor plates 212 and 222 face the finite ground plane 100, and thus the antenna device 25 illustrated in FIG. 26 is obtained.

In order to stably fix the shape in which the flexible substrate 700 is folded and bent, for example, it is desirable to fix a supporting member (not illustrated) made of a dielectric to the flexible substrate 700 through an adhesive. In this case, preferably, the height of the supporting member is set to be suitable for the height H of the conductor line 300 and the feed line 400.

In the present embodiment, the hole 750 is formed in the flexible substrate 700, and thus the flexible substrate 700 is easily folded and bent, but the hole 750 need not be necessarily formed. When the hole 750 is not formed in the flexible substrate 700, for example, a folding line is formed in the flexible substrate 700 along the alternate long and short dash lines D1 and D2 illustrated in FIG. 27A in advance, and thus the folding process can be easily performed.

As described above, in the antenna device 25 according to the present embodiment, the same effects as in the second embodiment are obtained, and the antenna device 25 can be easily manufactured by folding and bending the flexible substrate 700.

Accordingly, compared with the case in which parts of the antenna device 25 are individually manufactured and then mounted, for example, a process such as soldering can be omitted at the time of mounting, and thus the manufacturing cost can be reduced.

Further, since the dimension accuracy of patterning on the flexible substrate 700 is high, the dimension accuracy of each element can be increased by forming the first and second conductor plates 212 and 222, the conductor line 300, and the feed line 400 on the flexible substrate 700.

Accordingly, for example, when the dimensions of the first and second conductor plates 212 and 222 are adjusted, and the impedance of the antenna device 25 is adjusted, the impedance can be adjusted with a high degree of accuracy. The antenna device 25 having a detailed structure can be manufactured as designed.

In the embodiments and the modified examples described above, the conductor line is arranged in the positive Y axis direction further than the feed line, but the feed line may be arranged in the positive Y axis direction further than the conductor line. In other words, the conductor line and the feed line may be switched, the first conductor plate may be operated as the antenna element, and the second conductor plate may be operated as the parasitic element.

Further, each of antenna device described in the embodiments and the modified examples described above may further include a dielectric, and in this case, the antenna device that is smaller in size and more compact can be implemented. In this case, the dielectric may be arranged between, for example, at least one of the first and second conductor plates and the finite ground plane.

Ninth Embodiment

Next, an antenna device 26 according to a ninth embodiment will be described. The antenna device 26 is similar to the antenna device 12 of FIG. 4 except that a capacitance Cg occurring between the first conductor plate 212 and the second conductor plate 222 is larger than a capacitance Cr occurring between the first and second conductor plates 212 and 222 and the finite ground plane 100, and the same components as in the antenna device 12 of FIG. 4 are denoted by the same reference numerals, and a description thereof is omitted.

Figure 28A:
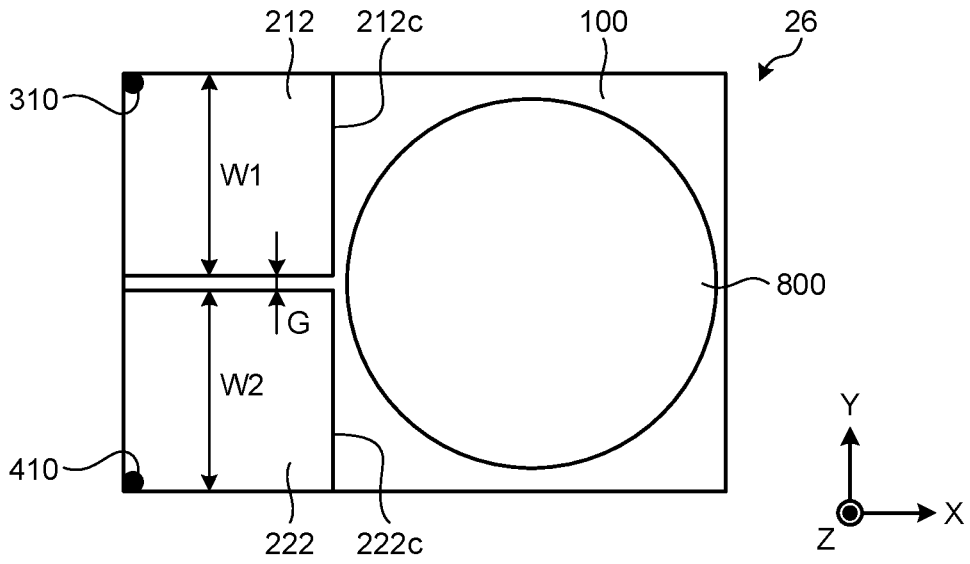
FIG. 28A is a diagram illustrating a configuration of an antenna device according to a ninth embodiment.
Figure 28B:
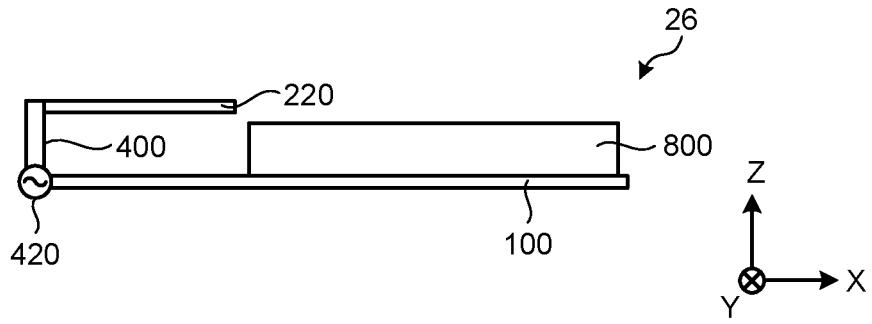
FIG. 28B is a diagram illustrating a configuration of the antenna device according to the ninth embodiment.

FIGS. 28A and 28B illustrate the antenna device 26 which is equipped with a battery 800 as an electronic part. FIG. 28A is a top view illustrating the antenna device 26 which is viewed in the Z-axis direction. FIG. 28B is a side view illustrating the antenna device 26 which is viewed in the Y-axis direction.

Some electronic parts are mounted on the finite ground plane 100 of the antenna device 26. FIG. 28 illustrates an example in which the battery 800 is mounted as the electronic part, but the electronic parts are not limited to the battery 800, and a switch, a display device, or the like may be mounted in the antenna device 26.

Generally, when electronic parts are mounted in the antenna device, performance of the antenna device deteriorates due to influence of such electronic parts. In this regard, in the antenna device 26 according to the present embodiment, the capacitance Cg occurring between the first conductor plate 212 and the second conductor plate 222 is set to be larger than the capacitance Cr occurring between the first and second conductor plates 212 and 222 and the finite ground plane 100, and thus even when such electronic parts are mounted, deterioration in the performance of the antenna device 26 is suppressed.

Figure 29A:
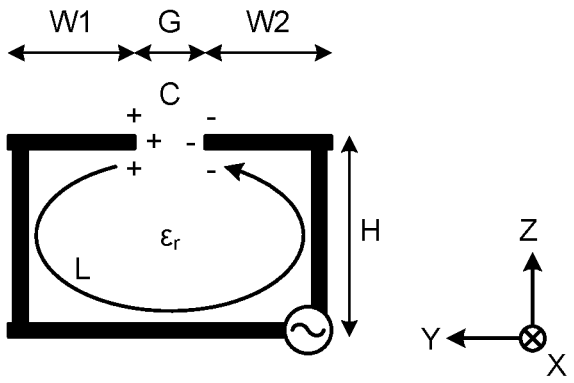
FIG. 29A is a diagram illustrating an equivalent circuit of the antenna device according to the ninth embodiment.
Figure 29B:
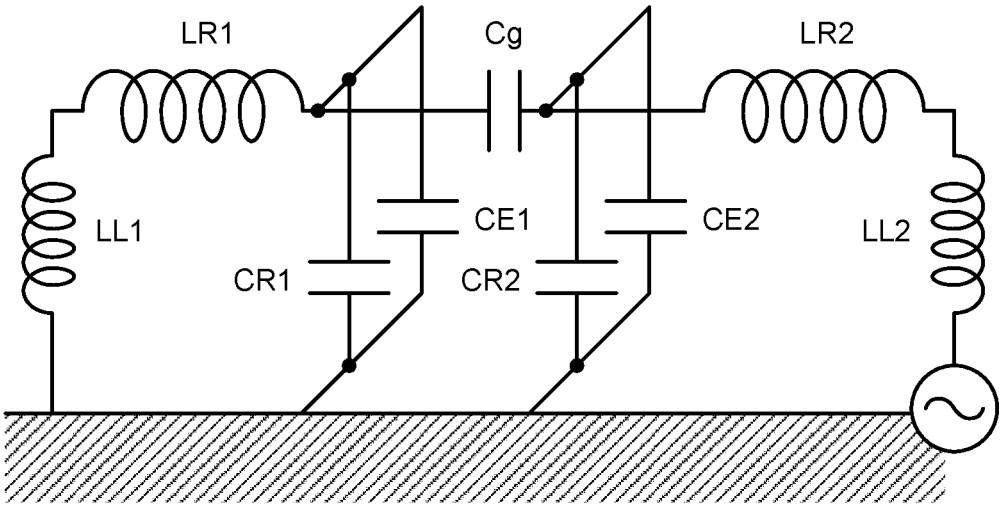
FIG. 29B is a diagram illustrating an equivalent circuit of the antenna device according to the ninth embodiment.

The point at which the deterioration in the performance of the antenna device 26 can be suppressed will be described with reference to FIGS. 29A and 29B. FIG. 29A is a diagram illustrating an equivalent circuit when the antenna device 26 is viewed in the X-axis direction. FIG. 29B is a diagram illustrating an equivalent circuit of the antenna device 26 equipped with the battery 800 illustrated in FIG. 28.

As illustrated in FIG. 29A, the antenna device 26 is indicated by a circuit having an inductance L and a capacitance C. The operation frequency f0 of the antenna device 26 is decided depending on the inductance L and the capacitance C. When a value of one of the inductance L and the capacitance C of the antenna device 26 is increased, the operation frequency f0 of the antenna device 26 decreases, and thus the size of the antenna device 26 can be reduced.

As illustrated in FIG. 29B, the antenna device 26 includes an inductance component LR1 by the first conductor plate 212 and an inductance component LR2 by the second conductor plate 222. The antenna device 26 includes an inductance component LL1 by the conductor line 300 and an inductance component LL2 by the feed line 400. The inductance L of the antenna device 26 is decided depending on the inductance components LR1, LR2, LL1, and LL2.

The antenna device 26 includes a capacitance component Cg between the first conductor plate 212 and the second conductor plate 222. The antenna device 26 further includes a capacitance component CR1 between the first conductor plate 212 and the finite ground plane 100 and a capacitance component CR2 between the second conductor plate 222 and the finite ground plane 100. The antenna device 26 includes a capacitance component CE1 between the first conductor plate 212 and the battery 800 and a capacitance component CE2 between the second conductor plate 222 and the battery 800. The capacitance C of the antenna device 26 is decided depending on the capacitance components Cg, CR1, CR2, CE1, and CE2.

Here, the values of the capacitance components CR1 and CR2 change according to influence of electronic parts or the like mounted on the finite ground plane 100. The values of the capacitance components CE1 and CE2 change according to the size or an arrangement of the battery 800.

As described above, the values of the capacitance components CR1, CR2, CE1, and CE2 are likely to be influenced by electronic parts other than the antenna device 26. In other words, the operation frequency f0 of the antenna device 26 is likely to change depending on a type of electronic parts, the number of electronic parts, or an arrangement of electronic parts.

On the other hand, the value of the capacitance component Cg is decided depending on the sizes of the first and second conductor plates 212 and 222 and the gap G between the first and second conductor plates 212 and 222, and thus the value of the capacitance component Cg is unlikely to be influenced by other electronic parts such as the battery 800. In this regard, in the present embodiment, the capacitance component Cg is set to be larger than the capacitance components CR1, CR2, CE1, and CE2, and thus the change in the operation frequency f0 of the antenna device 26 by influence of electronic parts or the like is reduced.

Here, the antenna device 26 illustrated in FIGS. 28A and 28B, the capacitance components CR1 and CR2 are larger than the capacitance components CE1 and CE2. It is because the first and second conductor plates 212 and 222 and the finite ground plane 100 of the flat plate form are arranged to face each other, whereas the battery 800 and a sides 212*c* and 222*c* of the first and second conductor plates 212 and 222 are arranged to face each other.

In this regard, in the present embodiment, the antenna device 26 is configured so that Cg>CR1 (>CE1) and Cg>CR2 (>CE2) are satisfied, and thus the change in the operation frequency f0 of the antenna device 26 by influence of electronic parts or the like is reduced, and the deterioration in the performance of the antenna device 26 is suppressed.

Specifically, the capacitance Cr (=CR1+CR2) occurring between the first and second conductor plates 212 and 222 and the finite ground plane 100 is set to be smaller than the capacitance Cg occurring between the first conductor plate 212 and the second conductor plate 222 (Cr<Cg). In other words, the capacitance Cg occurring between the first conductor plate 212 and the second conductor plate 222 is set to satisfy Formula (1).

$$\frac{\varepsilon_0 \varepsilon_r W_a^2}{4h} < C_g \tag{1}$$

$\varepsilon_0$ indicates a permittivity of a vacuum, $\varepsilon_r$ indicates a relative permittivity of a space surrounded by the first and second conductor plates 212 and 222 and the finite ground plane 100 (see FIG. 29A), $W_a$ indicates an arithmetic mean of the width W1 of the first conductor plate 212 and the width W2 of the second conductor plate 222, and h indicates an average distance between the first and second conductor plates 212 and 222 and the finite ground plane 100 (h=H in FIG. 29A).

The capacitance Cg occurring between the first conductor plate 212 and the second conductor plate 222 is obtained by the following Formula (2).

$$C_g = \frac{W_a \varepsilon_0 (1+\varepsilon_r)}{2\pi} \cosh^{-1}\left(\frac{W_a + 2G}{2G}\right) \tag{2}$$

G is a gap between the first conductor plate 212 and the second conductor plate 222 (see FIG. 29A), and π indicates the ratio of the circumference of a circle to the diameter.

Since the first conductor plate 212 and the second conductor plate 222 are arranged to be adjacent to each other, G<<Wa is held. Based on G<<Wa and Formulae (1) and (2), the antenna device 26 satisfying Formula (1) is obtained by arranging the first and second conductor plates 212 and 222 so that the gap G between the first conductor plate 212 and the second conductor plate 222 satisfies Formula (3).

$$G < 2W_a \exp\left(-\frac{W_a \varepsilon_r \pi}{2h(1+\varepsilon_r)}\right) \tag{3}$$

As described above, according to the antenna device 26 according to the present embodiment, the same effects as in the second embodiment are obtained. Further, since the capacitance Cg occurring between the first conductor plate 212 and the second conductor plate 222 is set to be larger than the capacitance Cr occurring between the first and second conductor plates 212 and 222 and the finite ground plane 100, even when electronic parts are mounted in the antenna device 26, the deterioration in the performance of the antenna device 26 can be suppressed.

Figure 30:
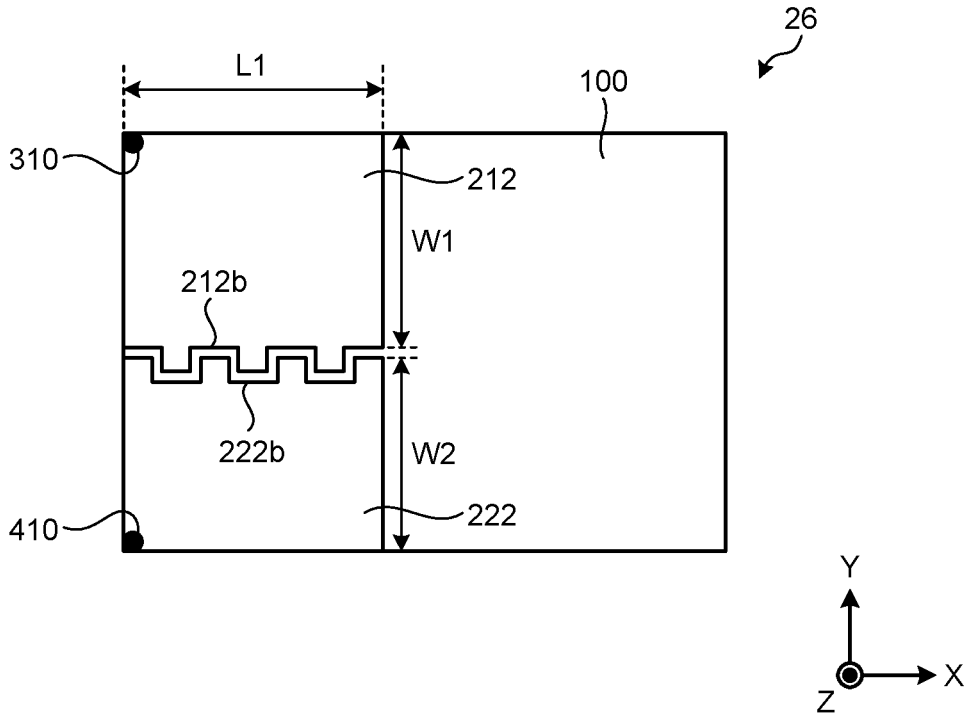
FIG. 30 is a diagram illustrating a configuration of the antenna device according to the ninth embodiment.

Further, for example, when a sides 212*b* and 222*b* of the first and second conductor plates 212 and 222 which are adjacent to each other are formed in the meander form as illustrated in FIG. 30, the capacitance Cg occurring between the first conductor plate 212 and the second conductor plate 222 may be increased.

Fifth Modified Example

Figure 31A:
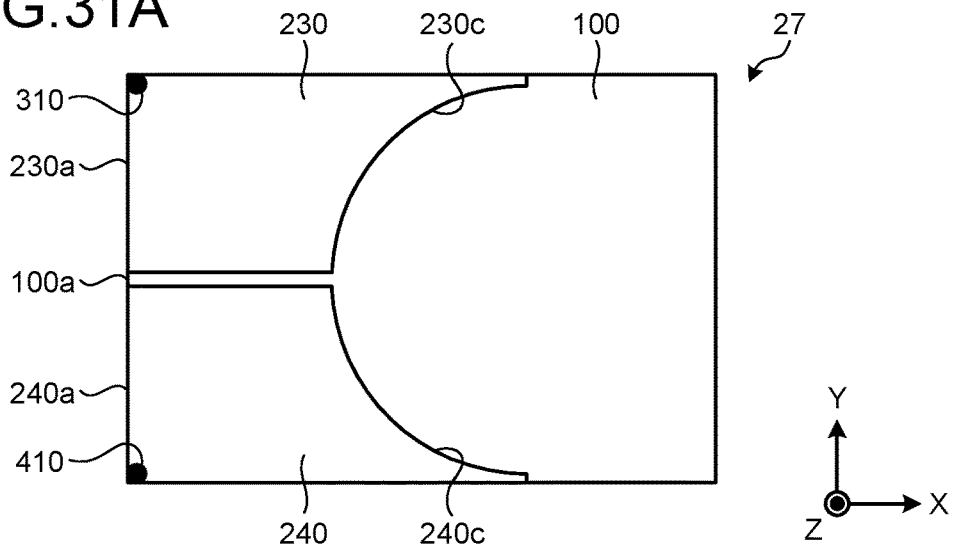
FIG. 31A is a diagram illustrating an antenna device according to a fifth modified example.
Figure 31B:
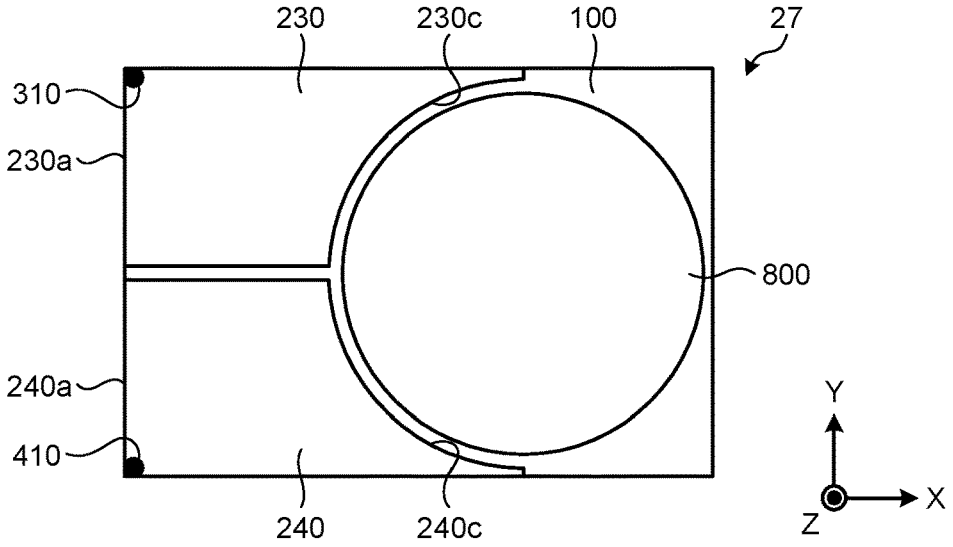
FIG. 31B is a diagram illustrating an antenna device according to the fifth modified example.
Figure 31C:
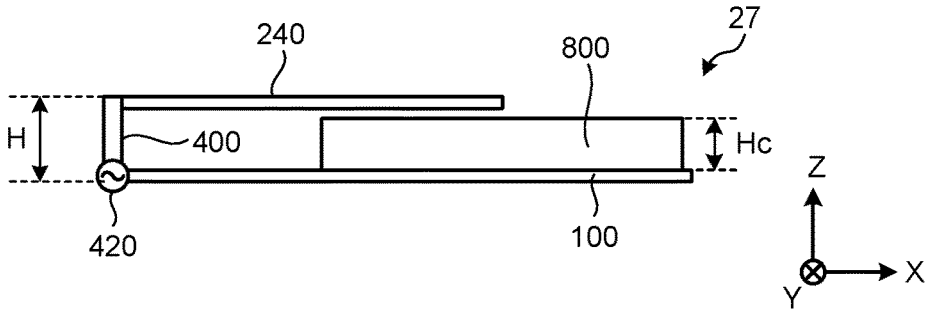
FIG. 31C is a diagram illustrating an antenna device according to the fifth modified example.

FIGS. 31A to 31C illustrate an antenna device 27 according to a fifth modified example of the ninth embodiment. FIG. 31A is a top view illustrating an antenna device 27 according to the present modified example which is viewed in the Z-axis direction. FIG. 31B is a top view when the battery 800 is mounted in the antenna device 27, and FIG. 31C is a side view when the battery 800 is mounted in the antenna device 27.

In the antenna device 27 according to the present modified example, similarly to the antenna device 26, a capacitance Cg occurring between the first conductor plate 230 and the second conductor plate 240 is set to be larger than a capacitance Cr occurring between the first and second conductor plates 230 and 240 and the finite ground plane 100.

Accordingly, even when electronic parts are mounted in the antenna device 27, the deterioration in the performance of the antenna device 27 can be suppressed. Therefore, the first and second conductor plates 230 and 240 of the antenna device 27 can be mounted nearby the electronic parts.

Thus, in the present modified example, the first and second conductor plates 230 and 240 can be formed according to an external form of electronic parts. FIGS. 31A to 31C illustrate an example in which a circular battery 800 such as a button-shaped battery is mounted as an electronic part.

FIG. 31A illustrates the antenna device 27 before the battery 800 is mounted. The first conductor plate 230 of FIG. 31A includes a side 230*a* corresponding to the side 100*a* of the finite ground plane 100 and a side 230*c* facing the side 230*a*. The second conductor plate 240 includes a side 240*a* corresponding to the side 100*a* of the finite ground plane 100 and a side 240*c* facing the side 240*a*.

As illustrated in FIG. 31B, in the antenna device 27, the sides 230*c* and 240*c* of the first and second conductor plates 230 and 240 are formed in a curved line form along the external form of the battery 800. The remaining components except this point are the same as in the antenna device 26 illustrated in FIGS. 28A and 28B, and the same components are denoted by the same reference numerals, and a description thereof is omitted.

Since the sides 230*c* and 240*c* of the first and second conductor plates 230 and 240 are formed in a curved line form along the external form of the battery 800, even when the battery 800 is mounted in the antenna device 27, the first and second conductor plates 230 and 240 can be mounted in a limited mounting space after the battery 800 is mounted.

Further, as illustrated in FIG. 31C, in the present modified example, the height H of the first and second conductor plates 230 and 240 of the antenna device 27 from the finite ground plane 100 is set to be higher than a height Hc of the battery 800. In other words, the lengths H of the conductor line 300 and the feed line 400 is larger than the height Hc of the battery 800. Accordingly, compared to when the height H is set to be equal to the height Hc of the battery 800, the distance between the first and second conductor plates 230 and 240 and the battery 800 can be increased, and influence by the battery 800 can be further reduced.

The ninth embodiment and the fifth modified example have been described in connection with the example in which the capacitance Cg occurring between the first conductor plate 212 and the second conductor plate 222 of the antenna device 12 is set to be larger than the capacitance Cr occurring between the first and second conductor plates 212 and 222 and the finite ground plane 100, but the capacitance Cg may be similarly set to be larger than the capacitance Cr in other antenna devices. The antenna devices 26 and 27 according to the ninth embodiment and the fifth modified example may be manufactured through the method of manufacturing the antenna device 25 according to the eighth embodiment.

The exemplary embodiments of the present invention have been described, but the above embodiments are proposed as examples and not intended to limit the scope of the invention. The new embodiments can be carried in various other forms, and various omission, replacements, or changes can be made within the scope not departing from the gist of the invention. The embodiments and modifications thereof are included in the scope or gist of the invention and included in the scope of inventions stated in claims and equivalent scopes thereto.

The invention claimed is:

1. An antenna device, comprising:

a finite ground plane configured to include a linear side;

a first conductor plate configured to face the finite ground plane and include a side corresponding to the linear side of the finite ground plane and having a length of substantially ⅛ or less of an operation wavelength;

a conductor line configured to include one end connected to the side of the first conductor plate and the other end short-circuited to a corner portion of the finite ground plane;

a second conductor plate configured to face the finite ground plane, include a side corresponding to the linear side of the finite ground plane and having a length of substantially ⅛ or less of the operation wavelength, the second conductor plate being arranged to be adjacent to the first conductor plate to perform capacitive coupling with the first conductor plate; and a feed line configured to include one end connected to the side of the second conductor plate and the other end connected to another corner portion of the finite ground plane.

2. The antenna device according to claim 1, wherein the length of the side of the first conductor plate is substantially 1/16 or more of the operation wavelength, and the length of the side of the second conductor plate is substantially 1/16 or more of the operation wavelength.

3. The antenna device according to claim 1, wherein the length of the side of the first conductor plate is different from the length of the side of the second conductor plate.

4. The antenna device according to claim 1, wherein a length of a side of the first conductor plate adjacent to the second conductor plate is different from a length of a side of the second conductor plate adjacent to the first conductor plate.

5. The antenna device according to claim 1, wherein a side facing at least one of the sides of the first conductor plate and the second conductor plate is formed in a taper form.

6. The antenna device according to claim 1, wherein a side facing at least one of sides of the first conductor plate and the second conductor plate that are adjacent to each other are formed in a taper form.

7. The antenna device according to claim 1, wherein a height of the first conductor plate from the finite ground plane is different from a height of the second conductor plate from the finite ground plane.

8. The antenna device according to claim 1, wherein at least one of the first conductor plate and the second conductor plate is a mesh-like plate.

9. The antenna device according to claim 1, wherein at least one of the conductor line and the feed line is formed in a helical form or a meander form.

10. The antenna device according to claim 1, wherein the first conductor plate, the conductor line, the second conductor plate, and the feed line are metallic films formed on a flexible substrate.

11. The antenna device according to claim 1, wherein a capacitance between the first conductor plate and the second conductor plate is larger than a capacitance between the first and second conductor plates and the finite ground plane.

12. The antenna device according to claim 1, wherein a capacitance Cg between the first conductor plate and the second conductor plate satisfies:

$$\frac{\varepsilon_0 \varepsilon_r W_a^2}{4h} < C_g$$

where $\varepsilon_0$ indicates a permittivity of a vacuum, $\varepsilon_r$ indicates a relative permittivity of a space surrounded by the first and second conductor plates and the finite ground plane, $W_a$ indicates an arithmetic mean of a length W1 of the side of the first conductor plate and a length W2 of the side of the second conductor plate, and h indicates a distance between the first and second conductor plates and the finite ground plane.

13. The antenna device according to claim 12, wherein a distance G between the first conductor plate and the second conductor plate satisfies:

$$G < 2W_a \exp\left(-\frac{W_a \varepsilon_r \pi}{2h(1+\varepsilon_r)}\right)$$

14. The antenna device according to claim 1, wherein the first and second conductor plates have a shape along an external form of electronic parts.

15. The antenna device according to claim 1, wherein the one end of the conductor line is connected to one end portion of the side of the first conductor plate corresponding to the linear side of the finite ground plane; and the one end of the feed line is connected to one end portion of the side of the second conductor plate corresponding to the linear side of the finite ground place.

* * * * *